US011407226B2

(12) United States Patent
Furukawa et al.

(10) Patent No.: US 11,407,226 B2
(45) Date of Patent: Aug. 9, 2022

(54) IMAGE RECORDING METHOD AND INK SET

(71) Applicants: Juichi Furukawa, Kanagawa (JP); Tatsuya Tomura, Tokyo (JP)

(72) Inventors: Juichi Furukawa, Kanagawa (JP); Tatsuya Tomura, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/159,756

(22) Filed: Jan. 27, 2021

(65) Prior Publication Data

US 2021/0237454 A1 Aug. 5, 2021

(30) Foreign Application Priority Data

Jan. 30, 2020 (JP) ..... JP2020-013756
Jan. 8, 2021 (JP) ..... JP2021-002383

(51) Int. Cl.

| | |
|---|---|
| ***B41M 5/00*** | (2006.01) |
| ***B41M 5/52*** | (2006.01) |
| ***B41J 2/17*** | (2006.01) |
| ***B41J 2/195*** | (2006.01) |
| *B41J 2/175* | (2006.01) |
| *B41J 29/13* | (2006.01) |

(52) U.S. Cl.

CPC ..... *B41J 2/1707* (2013.01); *B41J 2/195* (2013.01); *B41M 5/0011* (2013.01); *B41M 5/0017* (2013.01); *B41J 2/17509* (2013.01); *B41J 29/13* (2013.01); *B41M 5/52* (2013.01); *B41M 5/5218* (2013.01); *B41M 5/5245* (2013.01)

(58) Field of Classification Search

CPC ..... B41J 2/1707; B41J 2/195; B41J 2/17509; B41J 29/13; B41M 5/0011; B41M 5/0017; B41M 5/52; B41M 5/5218; B41M 5/5245

See application file for complete search history.

(56) References Cited

U.S. PATENT DOCUMENTS

| | | | | |
|---|---|---|---|---|
| 2006/0203056 | A1* | 9/2006 | Furukawa | C09D 11/30 347/96 |
| 2018/0056692 | A1 | 3/2018 | Tomura et al. | |
| 2018/0094155 | A1 | 4/2018 | Fujita et al. | |
| 2018/0118966 | A1 | 5/2018 | Tomura et al. | |
| 2018/0178538 | A1 | 6/2018 | Miyazawa et al. | |
| 2019/0010331 | A1 | 1/2019 | Fujita et al. | |
| 2019/0030940 | A1 | 1/2019 | Tomura et al. | |

(Continued)

FOREIGN PATENT DOCUMENTS

| | | |
|---|---|---|
| JP | 2004-207558 | 7/2004 |
| JP | 2005-154767 | 6/2005 |

(Continued)

*Primary Examiner* — Yaovi M Ameh

(74) *Attorney, Agent, or Firm* — Grüneberg and Myers PLLC

(57) ABSTRACT

An image recording method is provided. The image recording method includes the steps of: applying a treatment liquid containing a pore forming material onto a recording medium to form a porous layer; and applying a metallic ink containing a metallic pigment onto the porous layer. A surface tension of the metallic ink at 23° C. is equal to or greater than a surface tension of the treatment liquid at 23° C. The surface tension of the metallic ink at 23° C. is 19 mN/m or more and 28 mN/m or less.

15 Claims, 6 Drawing Sheets

(56) References Cited

U.S. PATENT DOCUMENTS

| | | | |
|---|---|---|---|
| 2019/0276692 | A1 | 9/2019 | Furukawa et al. |
| 2020/0224048 | A1 | 7/2020 | Furukawa et al. |

FOREIGN PATENT DOCUMENTS

| | | | | |
|---|---|---|---|---|
| JP | 2006-299329 | | 11/2006 | |
| JP | 2015-147405 | | 8/2015 | |
| JP | 2019-025905 | | 2/2019 | |
| WO | WO-2009028733 | A1 * | 3/2009 | ..... B41M 5/5218 |

* cited by examiner

IMAGE RECORDING METHOD AND INK SET

CROSS-REFERENCE TO RELATED APPLICATIONS

This patent application is based on and claims priority pursuant to 35 U.S.C. § 119(a) to Japanese Patent Application Nos. 2020-013756 and 2021-002383, filed on Jan. 30, 2020 and Jan. 8, 2021, respectively, in the Japan Patent Office, the entire disclosure of each of which is hereby incorporated by reference herein.

BACKGROUND

Technical Field

The present disclosure relates to an image recording method and an ink set.

Description of the Related Art

Print media have become more diverse recently. Varieties of print media are widely used in many fields, such as office printing, commercial printing, and large-scale printing.

Printed matter on such a print medium is capable of expressing a full-color image in which multiple colors are mixed.

Printed mater having metallic luster, particularly printed matter having an image containing a silver colorant having high specular image clarity, is capable of providing images having high image clarity by mixing the silver colorant with other colorants. Such a printed matter has high potential in industrial use.

SUMMARY

In accordance with some embodiments of the present invention, an image recording method is provided. The image recording method includes the steps of: applying a treatment liquid containing a pore forming material onto a recording medium to form a porous layer; and applying a metallic ink containing a metallic pigment onto the porous layer. A surface tension of the metallic ink at 23° C. is equal to or greater than a surface tension of the treatment liquid at 23° C. The surface tension of the metallic ink at 23° C. is 19 mN/m or more and 28 mN/m or less.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
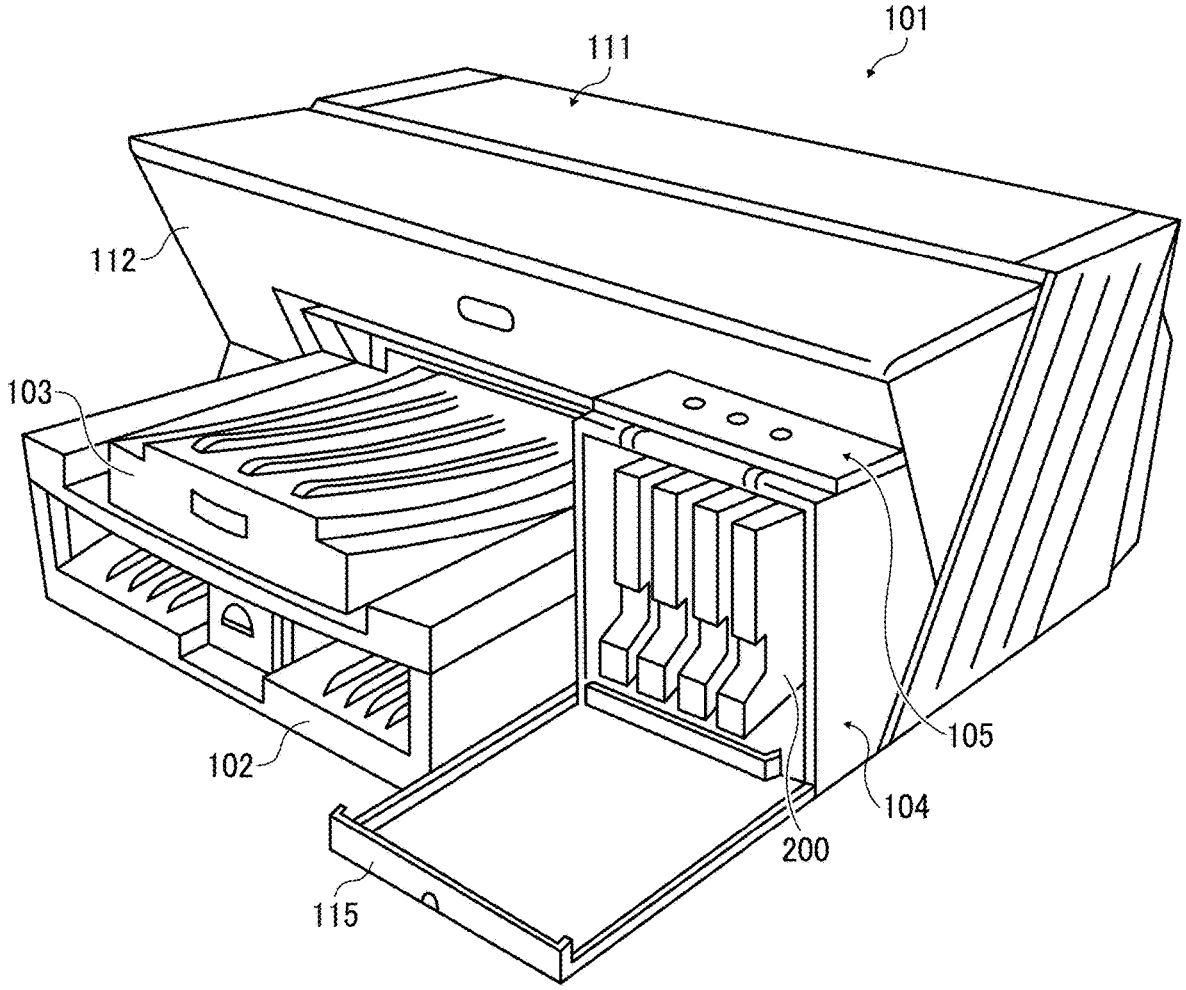
FIG. 1 is a perspective view of an image recording apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, an image recording method is provided that forms recorded matter having a high degree of the 20° glossiness.

In the present disclosure, a treatment liquid contains a pore forming material. The treatment liquid is applied onto a recording medium to form a porous layer (hereinafter also referred to as "ink absorbing layer") on the recording medium.

The porous layer has pores that absorb solutions and resins contained in the ink without absorbing metallic pigments in the ink.

In the present disclosure, the pores refer to voids which can be observed when the porous layer formed on the recording medium is observed from the pore-formed-surface side.

The pores may be observed by observing an image of the porous layer on the recording medium photographed using a scanning electron microscope (SEM).

By the use of the pore forming material (e.g., colloidal silica, colloidal alumina), an ink absorbing layer having both extremely high smoothness and high water absorptivity can be formed. As the metallic ink is applied onto the ink absorbing layer having both high smoothness and high water absorptivity, the pigment in the metallic ink forms an ink layer along the ink absorbing layer that is highly smooth. The resulted ink layer is provided with extremely high smoothness because it dries quickly due to the high water absorptivity without causing unevenness and beading.

The surface tension of the treatment liquid at 23° C. and the surface tension of the metallic ink at 23° C. satisfy the following relation (1).

$$\text{Surface tension of metallic ink} \geq \text{Surface tension of treatment liquid} \quad (1)$$

This indicates that it is desirable that the treatment liquid more easily gets wet with the recording medium.

In the present disclosure, the surface tension is measured using a measuring instrument Automatic Surface Tensiometer CBVP-Z, product of Kyowa Interface Science Co., Ltd.

In an image forming process in which the treatment liquid is discharged by a pre-jetting method, when the metallic ink overlaid on the dots of the treatment liquid formed on the recording medium gets wet protruding the area wetted with the treatment liquid, the protruding area and the non-protruding area exhibit different glossiness and the dot edges are bordered, resulting an image giving an impression that the glossiness is low as a whole. Preferably, the diameter of the dots formed with the treatment liquid is the same as or larger than the diameter of the dots formed with the metallic ink.

Preferably, the treatment liquid has a relatively high viscosity. The treatment liquid having a high viscosity and a low surface tension more effectively enhances image quality. Preferably, the viscosity is about 3 to 30 mPa·s. The treatment liquid becomes slowly permeable when the surface tension is low and the viscosity is relatively high. The slowly permeable treatment liquid droplets spread widely and thinly on the surface of a recording medium, even when applied thereto with a relatively small amount. Therefore, the metallic ink to be overlaid thereon can be prevented from bleeding and dried relatively quickly, which is preferable.

Figure 6:
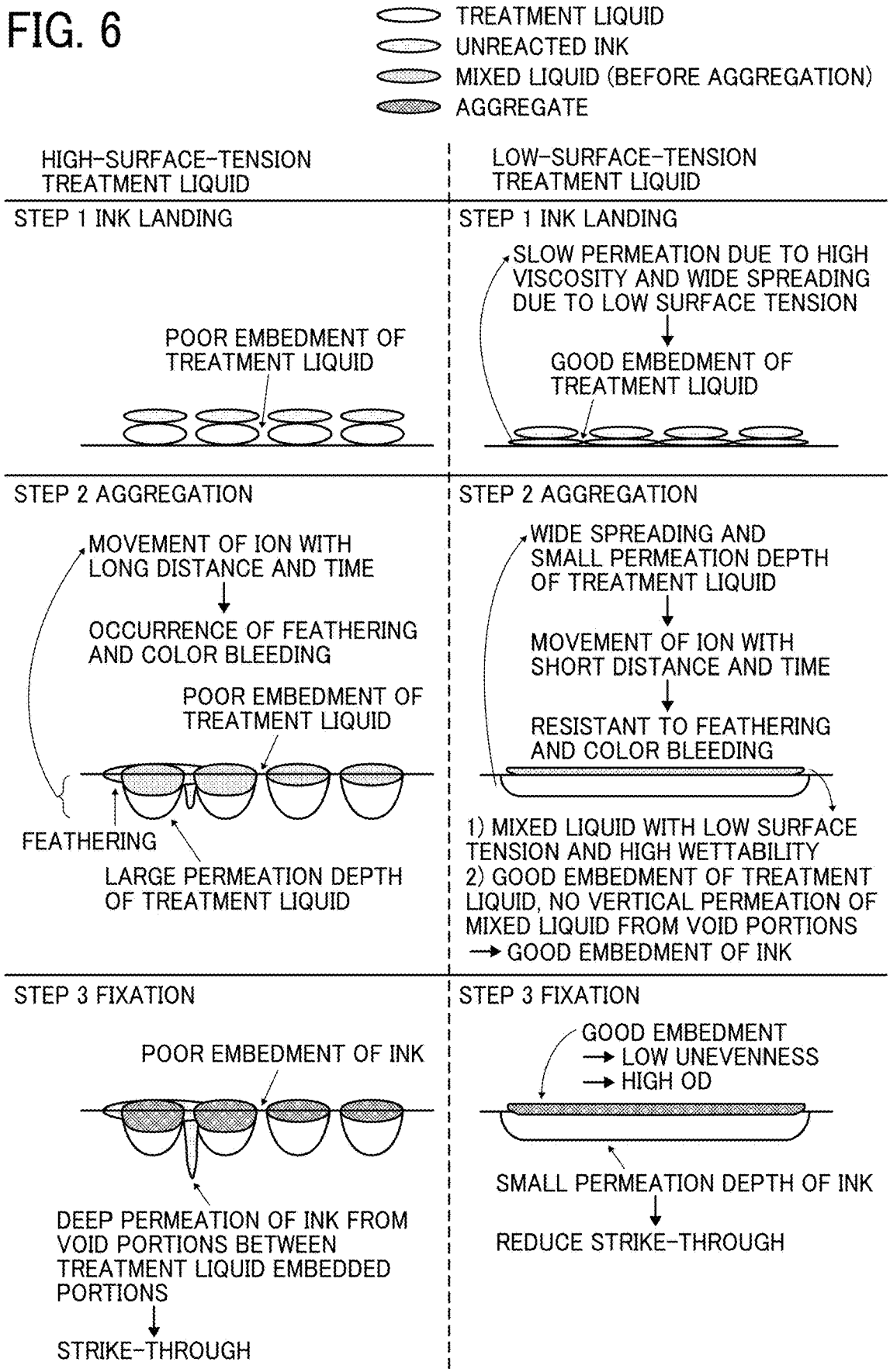
FIG. 6 is an explanatory diagram showing the states of treatment liquids having high or low surface tension, from landing of ink to fixing of ink.

As a result of observation of cross-sections of printed matter formed using a treatment liquid and a metallic ink in the same volume and the same ratio, it is confirmed that the thickness of the resulted layer is varied depending on the surface tension of the treatment liquid. Printed matter produced using a low-surface-tension treatment liquid has a thinner colorant layer and a low strike-through density. This phenomenon can be discussed with reference to FIG. 6 as follows. However, this phenomenon is not limited to the following discussion.

The above-described viscosity values are those measured using a C-type viscometer at 25° C.

Step 1: Immediately After Ink Landing

A high-surface-tension treatment liquid gets poorly embedded in a recording medium. A high-viscosity low-surface-tension treatment liquid does not immediately permeate the recording medium due to its high viscosity, and droplets thereof collapse and spread widely due to their low surface tension and get well embedded in the surface of the recording medium.

Step 2 to Step 3: Aggregation to Fixation

In the case of a high-surface-tension treatment liquid, the permeation depth is large, so that ions are required to move a longer distance and the reaction takes a period of time. During this period, the unreacted colorant spreads to cause a phenomenon called feathering, then the colorant permeates deep inside the recording medium from a portion where the treatment liquid is poorly embedded, causing a phenomenon called strike-through. In addition, the surface roughness of the ink layer of the metallic ink is significantly different between portions where the treatment liquid is present and other portions where the treatment liquid is not present, causing unevenness.

By contrast, a high-viscosity low-surface-tension treatment liquid spreads widely, and the permeation depth is small. Ions are required to move a relatively short distance, so that aggregation occurs in a relatively short time. Therefore, the occurrence of feathering and color bleeding is reduced. At the same time, the surface tension of the ink may be lowered. However, since the treatment liquid can be well embedded, the treatment liquid cannot permeate deep inside the recording medium but spreads laterally, resulting in better embedment of the colorant. Therefore, the 20° glossiness of the ink layer of the metallic ink is improved to reduce the unevenness.

Even in a pre-coating image forming process in which the entire surface of the recording medium is coated with the treatment liquid is applied before image formation, a low-surface-tension treatment liquid can form a flatter ink absorbing layer. An ink layer formed on the ink absorbing layer is affected by the surface roughness of the ink absorbing layer. Therefore, it is preferable that the surface tension of the treatment liquid be low. On the other hand, the surface tension of the metallic ink is low to the extent that solid images satisfy 100% duty, in consideration of trade-offs with defects such as image bleeding, feathering, and color boundary bleeding. The surface tension of the treatment liquid should be equal to or less than the surface tension of the metallic ink.

Specifically, the surface tension of the metallic ink is 19 mN/m or more and 28 mN/m or less, preferably 21 mN/m or more and 25 mN/m or less. When the surface tension is larger than 28 mN/m, the metallic ink cannot sufficiently get wet and spread, and high glossiness cannot be achieved. The ink absorbing layer formed of the treatment liquid according to the present embodiment has high water absorptivity, in which the solvent of the metallic ink easily permeates but poorly gets wet and spread. When the surface tension is lower than 19 mN/m, the metallic ink gets too wet and causes bleeding and color boundary bleeding with the color ink, which is not preferable.

To make the surface tension of the metallic ink be 19 mN/m or more and 28 mN/m or less, it is preferable that the metallic ink contain a surfactant. Further, to reduce the surface tension of the metallic ink, the metallic ink may contain a surfactant.

The surface tension of the treatment liquid is preferably 17 mN/m or more and 25 mN/m or less, more preferably 18 mN/m or more and 23 mN/m or less.

Preferably, the difference between the surface tension of the metallic ink and the surface tension of the treatment liquid is 0, or the surface tension of the metallic ink is larger than the surface tension of the treatment liquid.

Pore Forming Material

The pore forming material is not particularly limited as long as a porous layer that absorbs solutions and resins contained in the ink without absorbing the metallic pigment in the ink can be formed on a recording medium. Examples thereof include, but are not limited to, inorganic particles, hollow resin particles, and inorganic hollow particles. Preferably, the pore forming material comprises inorganic particles that have excellent safety as well as excellent film formability, film uniformity, and adhesiveness on/to recording media such as paper, resin substrates (e.g., polyethylene terephthalate (PET) and vinyl chloride), and non-absorptive recording media. Particularly preferably, the pore forming material comprises silica or alumina. A commercially available recording medium having a coating layer containing silica or alumina may be used. In this case, the porous layer according to the present embodiment may be formed by applying the pore forming material to the coating layer.

Physical properties of the treatment liquid, such as viscosity and surface tension, can be controlled by adjusting by the particle diameter of the pore forming material such as alumina and silica, the types of solvents and surfactants, etc. By controlling physical properties of the treatment liquid, the treatment liquid can be adjusted to have appropriate discharge property from an inkjet head.

Materials constituting the porous layer, such as alumina and silica, can be detected by X-ray fluorescence analysis.

Preferably, the porous layer has an average pore diameter of greater than 200 nm and not greater than 400 nm and an average thickness of 5 μm or more and to 30 μm or less.

The pore forming material has a pure water permeation rate, as a water absorptivity performance, of preferably 0.004 ($ml/m^2 \cdot ms$) or more and 0.16 ($ml/m^2 \cdot ms$) or less, more preferably 0.014 ($ml/m^2 \cdot ms$) or more and 0.11 ($ml/m^2 \cdot ms$) or less. Here, the pure water permeation rate is the average of those measured at 5 points of time (i.e., 33 ms, 72 ms, 127 ms, 197 ms, and 283 ms) from the start of contact.

The proportion of the pore forming material in the ink is preferably 0.5% by mass or more and 20% by mass or less, and more preferably 5% by mass or more and 15% by mass or less.

Preferably, the treatment liquid contains at least one of silica and alumina as the pore forming material, and optionally contains other materials such as a solvent, a resin, a surfactant, a defoamer, a preservative, a fungicide, a corrosion inhibitor, and a pH adjuster, if needed. To reduce the surface tension of the treatment liquid, it is preferable that the treatment liquid contain a surfactant.

Examples of the solvent include, but are not limited to, organic solvents and water.

In addition, commercially available sol-like or gel-like coating materials of silica and alumina may also be used.

Silica or Alumina

Silica or alumina serving as the pore forming material may have a spherical shape. Such spherical particles may be in a bead-like shape or a branched shape (e.g., a chain-like shape, a pearl-necklace-like shape) by a special treatment. In particular, secondary particles, which are aggregates of two or more primary particles, in a bead-like shape are preferred.

The surface of the pore forming material may be modified with an ion or compound, such as ammonia, calcium, and alumina.

Specific examples of the silica include, but are not limited to, commercially available products such as SNOWTEX series S, N, UP, PS-M, PS-S, ST-XS, ST-O-40, ST-O, ST-OS, ST-OXS, ST-C, ST-20, ST-30, OUP, PS-MO, and PS-SO (products of Nissan Chemical Corporation); CATALOID series SI-350, SI-30, SN, SA, S-20L, S-20H, S-30L, and S-30H (products of JGC Catalysts and Chemicals Ltd.); and AEROSIL series 200, 200V, 200CF, and 300 (products of Nippon Aerosil Co., Ltd.).

Specific examples of the alumina include, but are not limited to, commercially available products such as AS-200 (product of Nissan Chemical Corporation); AS-3J (product of JGC Catalysts and Chemicals Ltd.); and ALUMINA CLEAR SOL 5S, F1000, F3000, A2, 10A, 10D, and CSA-110AD (products of Kawaken Fine Chemicals Co., Ltd.).

In addition, silica whose surface is modified with alumina, such as SNOWTEX AK (product of Nissan Chemical Corporation), may also be used.

Preferably, the primary particle diameter of the inorganic particles (e.g., silica and alumina) is 10 nm or more and 200 nm or less.

The smaller the primary particle diameter, the flatter the porous layer and the higher the glitter property.

If the primary particle diameter is unchanged, the porosity and the glitter property of the particles are much higher when the particles are in a bead-like shape.

The proportion of silica or alumina in the treatment liquid is preferably 20% by mass or less, more preferably 15% by mass or less. When the treatment liquid contains both silica and alumina, the total proportion is preferably 20% by mass or less, more preferably 15% by mass or less.

Charge of Inorganic Particles

The dispersibility of the pigment in the metallic ink is secured by adjusting the charge of the pigment to be anionic or cationic.

Similarly, it is preferable that the dispersibility of the inorganic particles in the treatment liquid be secured by adjusting the charge of the inorganic particles to be anionic or cationic.

Here, when the pore forming material in the treatment liquid and solid contents in the metallic ink are both anionic or cationic, the metallic ink and the treatment liquid are not reactive with each other.

When the metallic ink and the treatment liquid are not reactive with each other, it is easy to mount a head for discharging the metallic ink and another head for discharging the treatment liquid on the same carriage. In this case, a pre-jetting image forming method can be performed in which the treatment liquid is first applied to a recording medium by an inkjet method and then the metallic ink is applied to the recording medium by an inkjet method.

When the pore forming material in the treatment liquid and solid contents in the metallic ink are independently anionic or cationic and the metallic ink and the treatment liquid are reactive with each other, it is not easy to mount a head for discharging the metallic ink and a head for discharging the treatment liquid on the same carriage for concerns on the occurrence of clogging of the inkjet head. In this case, for example, it is not possible to use a common maintenance unit. It is necessary to prepare a structure and a system that prevents the metallic ink and the treatment liquid from mixing with each other on each nozzle. An image recording apparatus incorporating such a system needs a large housing and high cost.

In a case in which the treatment liquid contains a cationic component and the metallic ink contains an anionic component, or the treatment liquid contains an anionic component and the metallic ink contains a cationic component, the inorganic particles and the metallic pigment cause an aggregation reaction.

Preferably, the metallic pigment, as a solid content in the metallic ink, can be either anionic or cationic, and is anionic when the treatment liquid contains a cationic component, and is cationic when the treatment liquid contains an anionic component. Aggregation of the metallic pigment and components in the treatment liquid improves bleeding resistance and scratch resistance of the metallic ink.

To ensure storage stability of the metallic ink, it is preferable that the other solid contents (e.g., surfactants, resins) in the metallic ink have the same polarity as the metallic pigment or be nonionic, so as not to aggregate with the metallic pigment.

The proportion of the metallic pigment in the ink is preferably 1.0% by mass or more and 30% by mass or less, more preferably 2.5% by mass or more and 20% by mass or less, for discharge stability.

When the treatment liquid contains a cationic component, it is preferable that the metallic pigment be anionic and the amount thereof be equal to or more than the amount of the cationic component but do not exceed 1.5 times the amount of the cationic component.

When the treatment liquid contains an anionic component, it is preferable that the metallic pigment be cationic and the amount thereof be equal to or more than the amount of the anionic component but do not exceed 1.5 times the amount of the anionic component.

When the proportion of the metallic pigment in the ink is 0.4% by mass or less, in either of the cases in which the ink contains a cationic pigment and the treatment liquid contains an anionic component or in which the ink contains or an anionic component and the treatment liquid contains a cationic component, the effects for bleeding resistance and scratch resistance are within the acceptable range.

When the metallic ink and the treatment liquid are reactive with each other, a pre-jetting image forming process can be performed by preparing a structure and a system in which an inkjet head for discharging the metallic ink and another inkjet head for discharging the treatment liquid are separately mounted on different carriages or in which an inkjet head for discharging the metallic ink and an inkjet head for discharging the treatment liquid are arranged sufficiently far from each other.

The metallic ink and the treatment liquid may also be used for a pre-coating image recording method.

In the pre-coating image recording method, first, a recording medium gets coated with the treatment liquid using a roller, a wire bar, or the like, and then the metallic ink is applied using an inkjet head.

In the pre-coating method, even when the metallic ink and the treatment liquid are reactive with each other, the inkjet head for discharging the metallic ink is less likely to cause clogging.

On the other hand, there is also an advantageous point when the treatment liquid is reactive with the metallic ink.

Even when the degree of drying of the treatment liquid is insufficient and formation of an ink absorbing layer is incomplete, the metallic pigment in the metallic ink applied onto the treatment liquid aggregates in separated two layers, i.e., a layer consisting of the pore forming material in the treatment liquid and another layer consisting of the metallic pigment, due to the reaction. Since the treatment liquid and the metallic ink are less likely to mix with each other, the metallic ink can be overlaid on the treatment liquid which is still being dried. Therefore, the image forming speed becomes faster than the case in which the treatment liquid is not reactive with the metallic ink.

Further, the metallic ink becomes less likely to get wet and spread due to the aggregation, the occurrence of bleeding is prevented, and the occurrence of color boundary bleeding is also prevented because redispersion is less likely to occur.

Regardless of whether the treatment liquid and the metallic ink are reactive with each other or not, it is preferable that the metallic ink be applied onto the ink absorbing layer after the treatment liquid has been sufficiently dried, because the surface roughness of the ink absorbing layer at the time of formation of the ink absorbing layer becomes flatter. In this case, an ink layer of the metallic ink is formed to have higher smoothness, which leads to production of recorded matter having high glitter property.

To sufficiently dry the treatment liquid, sufficient time and heat are required. When performing a serial-type inkjet printing by a pre-jetting method, a control should be made such that the treatment liquid and metallic ink are recorded on a recording medium without being overlapped on one another in the same pass.

It is preferable that, after the rate of solvent evaporation from the treatment liquid reaches 50% or more, the metallic ink be applied after a solid-gas interface is formed in the ink absorbing layer. In this case, the surface roughness of the ink layer of the metallic ink is not too large, leading to production of recorded matter having high glitter property.

When the rate of solvent evaporation from the treatment liquid is less than 50% and the treatment liquid and the metallic ink are not reactive with each other, the treatment liquid and the metallic ink get mixed after the metallic ink has landed. In this case, it is difficult to achieve high glitter property.

When the treatment liquid and the metallic ink are reactive with each other, the metallic ink and the treatment liquid may be separated into two layers to form an ink absorbing layer and a metallic ink layer. Even in this case, the solid-solid interface between the ink absorbing layer and the metallic ink layer is not flat. Therefore, it is difficult to achieve high glitter property.

The ink absorbing layer as formed above may be dried naturally at room temperature or heated to promote drying. The drying temperature is preferably from 30° C. to 80° C., and more preferably from 40° C. to 70° C. for improving drying property of the treatment liquid and preventing thickening of liquid components in the vicinity of the nozzle of the head.

The porous ink absorbing layer is preferably formed by an inkjet method, but may also be formed by applying the treatment liquid to a recording medium by blade coating, gravure coating, bar coating, roll coating, dip coating, curtain coating, slide coating, die coating, or spray coating.

Organic Solvent

The organic solvent contained in the treatment liquid and the metallic ink of the present disclosure is not particularly limited, and water-soluble organic solvents can be used. Examples thereof include polyols, ethers (e.g., polyol alkyl ethers and polyol aryl ethers), nitrogen-containing heterocyclic compounds, amides, amines, and sulfur-containing compounds.

Specific examples of the water-soluble organic solvents include, but are not limited to, polyols such as ethylene glycol, diethylene glycol, 1,2-propanediol, 1,3-propanediol, 1,2-butanediol, 1,3-butanediol, 1,4-butanediol, 2,3-butanediol, 3-methyl-1,3-butanediol, triethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and 3-methyl-1,3,5-pentanetriol; polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; polyol aryl ethers such as ethylene glycol monophenyl ether and ethylene glycol monobenzyl ether; nitrogen-containing heterocyclic compounds such as 2-pyrrolidone, N-methyl-2-pyrrolidone, N-hydroxyethyl-2-pyrrolidone, 1,3-dimethyl-2-imidazolidinone, ε-caprolactam, and γ-butyrolactone; amides such as formamide, N-methylformamide, N,N-dimethylformamide, 3-methoxy-N,N-dimethylpropionamide, and 3-butoxy-N,N-dimethylpropionamide; amines such as monoethanolamine, diethanolamine, and triethylamine; sulfur-containing compounds such as dimethyl sulfoxide, sulfolane, and thiodiethanol; propylene carbonate; and ethylene carbonate.

In particular, organic solvents having a boiling point of 250° C. or less are preferred, since they not only function as a wetting agent but also provide good drying property.

In addition, polyol compounds having 8 or more carbon atoms and glycol ether compounds are also preferred. Specific examples of the polyol compounds having 8 or more carbon atoms include, but are not limited to, 2-ethyl-1,3-hexanediol and 2,2,4-trimethyl-1,3-pentanediol.

Specific examples of the glycol ether compounds include, but are not limited to, polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; and polyol aryl ethers such as ethylene glycol monophenyl ether and ethylene glycol monobenzyl ether.

The polyol compounds having 8 or more carbon atoms and the glycol ether compounds are capable of improving paper-permeability of the treatment liquid, which is advantageous when paper is used as a recording medium.

The proportion of the organic solvent in the treatment liquid is not particularly limited and can be suitably selected to suit to a particular application, but is preferably from 10° % to 60% by mass, more preferably from 20% to 60% by mass, for drying property and discharge reliability of the treatment liquid.

Water

Water is a main medium of the treatment liquid. For reducing ionic impurities as much as possible, pure water such as ion-exchange water, ultrafiltration water, reverse osmosis water, and distilled water, and ultrapure water are preferably used as the medium of the treatment liquid. In addition, sterile water, sterilized by ultraviolet irradiation or addition of hydrogen peroxide, is preferably used for preventing generation of mold and bacteria during a long-term storage of the treatment liquid.

The proportion of water in the treatment liquid is not particularly limited and can be suitably selected to suit to a particular application, but is preferably from 10% to 75% by mass, more preferably from 20% to 60% by mass, for reducing environmental load and further including other components in the treatment liquid.

Resin

The type of the resin is not particularly limited and can be suitably selected to suit to a particular application. Specific examples thereof include, but are not limited to, urethane resins, polyester resins, acrylic resins, vinyl acetate resins, styrene resins, butadiene resins, styrene-butadiene resins, vinyl chloride resins, acrylic styrene resins, and acrylic silicone resins. Resin particles made of these resins may also be used. The resin particles may be dispersed in water serving as a dispersion medium to become a resin emulsion. The pore forming material can be obtained by mixing the resin emulsion with other materials such as colorants and organic solvents. These resin particles may be either synthesized products or commercially available products. The resin particles may include one type or two or more types of resin particles.

As the resin, a water-soluble resin is also preferably used. Specific examples of the water-soluble resins include, but are not limited to, proteins (e.g., gelatin, casein), natural rubbers (e.g., gum arabic), glucosides (e.g., saponin), cellulose derivatives (e.g., methyl cellulose, carboxymethyl cellulose, hydroxymethyl cellulose), lignosulfonate, natural polymers (e.g., shellac), polyacrylate, polyacrylamide, salts of styrene-acrylic acid copolymers, salts of vinylnaphthalene-acrylic acid copolymers, salts of styrene-maleic acid copolymers, salts of vinylnaphthalene-maleic acid copolymers, sodium salts of β-naphthalenesulfonic acid formalin condensates, ionic polymers (e.g., polyphosphoric acid), polyvinyl alcohol, polyvinyl butyral, polyethylene glycol, polypropylene glycol, polyethylene oxide, polyvinyl methyl ether, and polyethyleneimine.

The proportion of the resin in the treatment liquid is preferably from 0.05% to 10.0% by mass, and more preferably from 0.3% to 4.0% by mass. When the proportion is within this range, the resin can sufficiently exhibit its function to provide excellent scratch resistance. In addition, preferable metallic luster can be provided.

Surfactant

Usable surfactants include silicone-based surfactants, fluorine-based surfactants, amphoteric surfactants, nonionic surfactants, and anionic surfactants.

The silicone-based surfactants are not particularly limited and can be suitably selected to suit to a particular application.

Preferred are silicone-based surfactants which are not decomposed even in a high pH environment. Specific examples thereof include, but are not limited to, side-chain-modified polydimethylsiloxane, both-end-modified polydimethylsiloxane, one-end-modified polydimethylsiloxane, and side-chain-both-end-modified polydimethylsiloxane. In particular, those having a polyoxyethylene group and/or a polyoxyethylene polyoxypropylene group as the modifying group are preferable because they demonstrate good characteristics as an aqueous surfactant. Specific examples of the silicone-based surfactants further include polyether-modified silicone-based surfactants, such as a dimethyl siloxane compound having a polyalkylene oxide structure on a side chain which is bound to Si.

Specific preferred examples of the fluorine-based surfactants include, but are not limited to, perfluoroalkyl sulfonic acid compounds, perfluoroalkyl carboxylic acid compounds, perfluoroalkyl phosphate compounds, perfluoroalkyl ethylene oxide adducts, and polyoxyalkylene ether polymer compounds having a perfluoroalkyl ether group on a side chain, each of which has weak foaming property. Specific examples of the perfluoroalkyl sulfonic acid compounds include, but are not limited to, perfluoroalkyl sulfonic acid and perfluoroalkyl sulfonate. Specific examples of the perfluoroalkyl carboxylic acid compounds include, but are not limited to, perfluoroalkyl carboxylic acid and perfluoroalkyl carboxylate. Specific examples of the polyoxyalkylene ether polymer compounds having a perfluoroalkyl ether group on a side chain include, but are not limited to, a sulfate of a polyoxyalkylene ether polymer having a perfluoroalkyl ether group on its side chain, and a salt of a polyoxyalkylene ether polymer having a perfluoroalkyl ether group on its side chain. Specific examples of the counter ions for these fluorine-based surfactants include, but are not limited to, Li, Na, K, $NH_4$, $NH_3CH_2CH_2OH$, $NH_2(CH_2CH_2OH)_2$, and $NH(CH_2CH_2OH)_3$.

Specific examples of the amphoteric surfactants include, but are not limited to, laurylaminopropionate, lauryl dimethyl betaine, stearyl dimethyl betaine, and lauryl hydroxyethyl betaine.

Specific examples of the nonionic surfactants include, but are not limited to, polyoxyethylene alkyl phenyl ethers, polyoxyethylene alkyl esters, polyoxyethylene alkylamines, polyoxyethylene alkylamides, polyoxyethylene propylene block polymers, sorbitan fatty acid esters, polyoxyethylene sorbitan fatty acid esters, and ethylene oxide adducts of acetylene alcohol.

Specific examples of the anionic surfactants include, but are not limited to, acetate, dodecylbenzene sulfonate, and laurate of polyoxyethylene alkyl ether, and polyoxyethylene alkyl ether sulfate.

Each of these can be used alone or in combination with others.

The silicone-based surfactants are not particularly limited and can be suitably selected to suit to a particular application. Specific examples thereof include, but are not limited to, side-chain-modified polydimethylsiloxane, both-end-modified polydimethylsiloxane, one-end-modified polydimethylsiloxane, and side-chain-and-both-end-modified polydimethylsiloxane. More specifically, polyether-modified silicone-based surfactants having polyoxyethylene group and/or polyoxyethylene polyoxypropylene group as the modifying groups are preferable since they exhibit good properties as an aqueous surfactant.

These surfactants may be either synthesized products or commercially available products. Commercial products are readily available from, for example, BYK-Chemie GmbH, Shin-Etsu Chemical Co., Ltd., Dow Corning Toray Silicone Co., Ltd., Nihon Emulsion Co., Ltd., and Kyoeisha Chemical Co., Ltd.

The polyether-modified silicone-based surfactants are not particularly limited and can be suitably selected to suit to a particular application. Specific examples thereof include, but are not limited to, a compound represented by the following general formula (S-1) that is a dimethylpolysiloxane having a polyalkylene oxide structure on a side chain which is bound to Si.

General Formula (S-1)

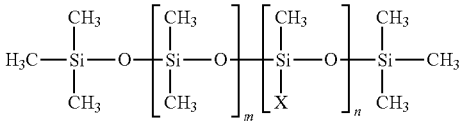

$X = -R(C_2H_4O)_a(C_3H_6O)_b R'$

In the general formula (S-1), each of m, n, a, and b independently represents an integer, R represents an alkylene group, and R' represents an alkyl group.

Specific examples of commercially available products of the polyether-modified silicone-based surfactants include, but are not limited to: KF-618, KF-642, and KF-643 (products of Shin-Etsu Chemical Co., Ltd.); EMALEX-SS-5602 and SS-1906EX (products of Nihon Emulsion Co., Ltd.); FZ-2105, FZ-2118, FZ-2154, FZ-2161, FZ-2162, FZ-2163, and FZ-2164 (products of Dow Corning Toray Silicone Co., Ltd.); BYK-33 and BYK-387 (products of BYK-Chemie GmbH); and TSF4440, TSF4452, and TSF4453 (products of Momentive Performance Materials Inc.).

Preferably, the fluorine-based surfactant is a compound having 2 to 16 fluorine-substituted carbon atoms, more preferably a compound having 4 to 16 fluorine-substituted carbon atoms.

Specific examples of the fluorine-based surfactant include, but are not limited to, perfluoroalkyl phosphate compounds, perfluoroalkyl ethylene oxide adducts, and polyoxyalkylene ether polymer compounds having a perfluoroalkyl ether group on a side chain.

Among these, polyoxyalkylene ether polymer compounds having a perfluoroalkyl ether group on a side chain are preferred for their small foaming property. More specifically, compounds represented by the following general formula (F-1) or (F-2) are preferred as the fluorine-based surfactants.

$$CF_3CF_2(CF_2CF_2)_m—CH_2CH_2O(CH_2CH_2O)_nH \quad \text{General Formula (F-1)}$$

In the general formula (F-1), preferably, m is an integer of from 0 to 10 and n is an integer of from 0 to 40, for imparting water-solubility to the compound.

$$C_nF_{2n+1}—CH_2CH(OH)CH_2—O—(CH_2CH_2O)_a—Y \quad \text{General Formula (F-2)}$$

In the general formula (F-2), Y represents H, $C_mF_{2m+1}$ (where m represents an integer of from 1 to 6), $CH_2CH(OH)CH_2—C_mF_{2m+1}$ (where m represents an integer of from 4 to 6), or $C_pH_{2p+1}$ (where p represents an integer of from 1 to 19); n represents an integer of from 1 to 6; and a represents an integer of from 4 to 14.

The fluorine-based surfactants may be commercially available products.

Specific examples of commercially available fluorine-based surfactants include, but are not limited to: SURFLON S-111, S-112, S-113, S-121, S-131, S-132, S-141, and S-145 (products of Asahi Glass Co., Ltd.); Fluorad™ FC-93, FC-95, FC-98, FC-129, FC-135, FC-170C, FC-430, and FC-431 (products of Sumitomo 3M Limited); MEGAFACE F-470, F-1405, and F-474 (products of DIC Corporation); ZONYL TBS, FSP, FSA, FSN-100, FSN, FSO-100, FSO, FS-300, UR, CAPSTONE FS-30, FS-31, FS-3100, FS-34, and FS-35 (products of The Chemours Company); FT-110, FT-250, FT-251, FT-400S, FT-150, and FT-400SW (products of NEOS COMPANY LIMITED); PolyFox PF-136A, PF-156A, PF-151N, PF-154, and PF-159 (products of OMNOVA Solutions Inc.); and UNIDYNE™ DSN-403N (products of Daikin Industries, Ltd.). Among these, for improving printing quality, in particular color developing property, paper permeability, paper wettability, and uniform dying property, FS-3100, FS-34, and FS-300 (products of The Chemours Company), FT-110, FT-250, FT-251, FT-400S, FT-150, and FT-400SW (products of NEOS COMPANY LIMITED), PolyFox PF-151N (product of OMNOVA Solutions Inc.), and UNIDYNE™ DSN-403N (product of DAIKIN INDUSTRIES, LTD.) are particularly preferred.

The proportion of the surfactant in the treatment liquid is not particularly limited and can be suitably selected to suit to a particular application, but is preferably from 0.001% to 5% by mass, more preferably from 0.05% to 5% by mass, for improving wettability and discharge stability and enhancing image quality.

Defoamer

Specific examples of the defoamer include, but are not limited to, silicone-based defoamers, polyether-based defoamers, and fatty-acid-ester-based defoamers. Each of these can be used alone or in combination with others. Among these defoamers, silicone-based defoamers are preferred for their excellent defoaming ability.

Preservative and Fungicide

Specific examples of the preservative and fungicide include, but are not limited to, 1,2-benzisothiazoline-3-one.

Corrosion Inhibitor

Specific examples of the corrosion inhibitor include, but are not limited to, acid sulphite and sodium thiosulfate.

pH Adjuster

A pH adjuster is for adjusting the pH to assist dispersion of the pore forming material. According to this purpose, for an anionic treatment liquid having a pH of 7 or higher, amines such as diethanolamine and triethanolamine can be used as the pH adjuster.

Preferably, the viscosity of the treatment liquid at 25° C. is from 5 to 30 mPa·s, more preferably from 5 to 25 mPa·s, for improving print density and text quality and achieving good dischargibility. The viscosity can be measured at 25° C. using a rotatory viscometer (RE-80L, product of Toki Sangyo Co., Ltd.) equipped with a standard cone rotor (1°34'×R24), while setting the sample liquid amount to 1.2 mL, the number of rotations to 50 rotations per minute (rpm), and the measuring time to 3 minutes.

Metallic Pigment

The metallic ink according to the present embodiment contains a metallic pigment. The metallic pigment contained in the metallic ink is not particularly limited as long as droplets of the metallic ink can be discharged by an inkjet recording method. Glitter pigments have a function of imparting glitter property when the metallic ink adheres to a resin ink layer, and also imparting glitter property to the adhered matter. Examples of such glitter pigments include pearl pigments and metal particles. Specific examples of the pearl pigments include pigments having pearl luster or interference luster, such as titanium-dioxide-coated mica, fish scale foil, and bismuth oxychloride. Specific examples of the metal particles include particles of at least one selected from: single substances such as aluminum, silver, gold, platinum, nickel, chromium, tin, zinc, indium, titanium, and copper; alloys thereof; and mixtures thereof. Each of these pearl pigments and metal particles exerts an effect as the metallic pigment of the present embodiment. In particular, silver particles are preferred for achieving high glossiness (glitter property). Hereinafter, a silver ink is described as a specific example of the metallic ink containing a metallic pigment.

Metallic Ink Applying Process and Metallic Ink Applying Device

In a metallic ink applying process, the metallic ink is applied to the porous layer formed by applying the treatment liquid to a recording medium. The metallic ink applying process is performed by a metallic ink applying device.

The metallic ink applying process may be performed by applying the metallic ink to the porous layer using, for example, a bar coater or an inkjet head.

Examples of the metallic ink applying device include, but are not limited to, a bar coater and an inkjet head.

It is preferable that the metallic ink applying process be performed continuously with the porous layer forming process. In a case in which the metallic ink applying process and the porous layer forming process are performed continuously, the metallic ink applying process and the porous layer forming process may be performed by either separate apparatuses or the same apparatus. When these processes are performed by the same apparatus, recorded matter with more excellent metallic luster and image clarity can be obtained as the productivity is improved as well as landing of the metallic ink on the porous layer can be appropriately controlled.

Ink Containing Silver

An ink containing silver (hereinafter "silver ink") may optionally contain additives such as a polymer dispersant, an organic solvent, water, a resin, a surfactant, a defoamer, a fungicide, a preservative, a corrosion inhibitor, and a pH adjuster, if needed. The silver ink may be prepared as a silver colloid containing silver, water, and a solvent having a moisturizing function. The above-described additives may be added thereto as necessary. Silver is a metal having a higher degree of whiteness among various metals. Advantageously, silver can express various metallic colors when combined with inks having different colors. Silver is stable in water due to its weak reactivity with water. Therefore, silver can be applied to water-based glitter inks, which contributes to reduction of environmental load.

Specific examples of these additives, such as the organic solvent, water, resin, surfactant, defoamer, fungicide, preservative, and pH adjuster, include those exemplified as additives for the treatment liquid.

The effects of these additives, contents of these additives, and properties of the silver ink are also the same as those for the treatment liquid.

Silver

The silver is capable of improving image clarity and metallic luster of the recorded matter. The silver preferably comprises silver particles. Preferably, the silver particles have a number average particle diameter of from 15 to 100 nm, more preferably from 30 to 60 nm. When the number average particle diameter is 15 nm or more, it is prevented that nano particles of the silver enter into the porous layer to be present at the lowermost surface of the recorded matter and that the color tone becomes unnatural due to an adverse affect of the yellow color of the nano silver particles. Thus, metallic luster is well improved. When the number average particle diameter is 100 nm or less, the ink can be reliably discharged without causing precipitation of the silver with time.

The number average particle diameter can be measured using a laser diffraction particle size distribution analyzer. Specific examples of the laser diffraction particle size distribution analyzer include, but are not limited to, those employing a dynamic light scattering method, such as MICROTRACK UPA, product of Nikkiso Co., Ltd.

The proportion of the silver in the silver ink is preferably from 1.0% to 15.0% by mass, and more preferably from 2.5% to 10% by mass. When the proportion is 1.0% by mass or more, high image clarity and metallic luster are developed. When the proportion is 15.0% by mass or less, dispersion stability of the silver and storage stability and discharge stability of the silver ink are improved.

Silver Colloid Liquid

Preferably, the silver is dispersed in an aqueous dispersion medium to form silver colloids to the surface of which protection colloids are adhered. In this case, the silver can be well dispersed in the aqueous dispersion medium and storage stability of the silver ink is drastically improved. The silver colloids may be prepared by, for example, reducing silver ions contained in a solution with a reducing agent in the presence of protection colloids, as described in JP-2006-299329-A. In a case in which silver colloids are prepared by such a method, dispersion stability of the silver particles is more improved as a surfactant is added to the solution at any time before and after the reduction reaction. The protection colloids are not limited so long as they comprise an organic matter capable of protecting the surfaces of silver. Specific examples of such organic matter include, but are not limited to, carboxyl-group-containing organic compounds and polymeric dispersants. Each of these materials can be used alone or combination with others. Combinations are more preferable for their synergistic effects.

Carboxyl-Group-Containing Organic Compounds

The number of carboxyl groups in one molecule of the carboxyl-group-containing organic compound is at least one, preferably from 1 to 10, more preferably from 1 to 5, and most preferably from 1 to 3, but is not limited thereto. A part or all of the carboxyl groups in the carboxyl-group-containing organic compound may form a salt (e.g., amine salt, metal salt). In particular, organic compounds in which most carboxyl groups are not forming salts, i.e., organic compounds containing free carboxyl groups, are preferred. More particularly, organic compounds in which all the carboxyl groups are not forming salts (e.g., amine salts) with a basic compound (e.g., amine) are preferred.

The carboxyl-group-containing organic compound is not particularly limited and can be suitably selected to suit to a particular application as long as it contains carboxyl group, and may further contain a functional group (including a ligand group for metallic compounds or metallic nano particles) other than carboxyl group.

Examples of the functional group (or ligand group) other than the carboxyl group include, but are not limited to, a group (or functional group) having at least one hetero atom selected from halogen atom, nitrogen atom, oxygen atom, and sulfur atom; and a group forming a salt thereof (e.g., ammonium salt group). Each of these functional groups may be contained in the carboxyl-group-containing organic compound alone or in combination with others.

Specific examples of the halogen atom include, but are not limited to, fluorine atom, chlorine atom, bromine atom, and iodine atom.

Examples of the group having nitrogen atom include, but are not limited to, amino group, a substituted amino group (e.g., a dialkylamino group), imino group (—NH—), a nitrogen ring group (e.g., a 5- to 8-membered nitrogen ring group such as pyridyl group; carbazole group; and morpholinyl group), amide group (—CON<), cyano group, and nitro group.

Examples of the group having oxygen atom include, but are not limited to, hydroxyl group, an alkoxy group (e.g., an alkoxy group having 1 to 6 carbon atoms such as methoxy group, ethoxy group, propoxy group, and butoxy group), formyl group, carbonyl group (—CO—), ester group (—COO—), an oxygen ring group (e.g., a 5- to 8-membered oxygen ring group such as tetrahydropyranyl group).

Examples of the group having sulfur atom include, but are not limited to, thio group, thiol group, thiocarbonyl group (—SO—), an alkylthio group (e.g., an alkylthio group having 1 to 4 carbon atoms such as methylthio group and ethylthio group), sulfo group, sulfamoyl group, and sulfinyl group (—$SO_2$—).

Among the above functional groups, preferably, basic groups capable of forming a salt with carboxyl group, such as amino group, substituted amino group, imino group, and ammonium salt group, are preferably not contained in the carboxyl-group-containing organic compound.

Examples of the carboxyl-group-containing organic compound include carboxylic acids. Examples of the carboxylic acids include, but are not limited to, monocarboxylic acids, polycarboxylic acids, and hydroxycarboxylic acids (or oxycarboxylic acids).

Examples of the monocarboxylic acids include, but are not limited to, saturated aliphatic monocarboxylic acids, unsaturated aliphatic monocarboxylic acids, and aromatic monocarboxylic acids.

Specific examples of the saturated aliphatic monocarboxylic acids include, but are not limited to, aliphatic monocarboxylic acids having 1 to 34 carbon atoms (preferably aliphatic monocarboxylic acids having 1 to 30 carbon atoms) such as acetic acid, propionic acid, butyric acid, caprylic acid, caproic acid, hexanoic acid, capric acid, lauric acid, myristic acid, cyclohexane carboxylic acid, dehydrocholic acid, and cholanic acid.

Specific examples of the unsaturated aliphatic monocarboxylic acids include, but are not limited to, unsaturated aliphatic monocarboxylic acids having 4 to 34 carbon atoms (preferably unsaturated aliphatic monocarboxylic acids having 10 to 30 carbon atoms) such as oleic acid, erucic acid, linoleic acid, and abietic acid.

Specific examples of the aromatic monocarboxylic acids include, but are not limited to, aromatic monocarboxylic acids having 7 to 12 carbon atoms such as benzoic acid and naphthoic acid.

Examples of the polycarboxylic acids include, but are not limited to, aliphatic saturated polycarboxylic acids, aliphatic unsaturated polycarboxylic acids, and aromatic polycarboxylic acids.

Specific examples of the aliphatic saturated polycarboxylic acids include, but are not limited to, aliphatic saturated polycarboxylic acids having 2 to 14 carbon atoms (preferably aliphatic saturated polycarboxylic acids having 2 to 10 carbon atoms) such as oxalic acid, malonic acid, succinic acid, glutaric acid, adipic acid, azelaic acid, sebacic acid, and cyclohexanedicarboxylic acid.

Specific examples of the aliphatic unsaturated polycarboxylic acids include, but are not limited to, aliphatic unsaturated polycarboxylic acids having 4 to 14 carbon atoms (preferably unsaturated polycarboxylic acids having 4 to 10 carbon atoms) such as maleic acid, fumaric acid, itaconic acid, sorbic acid, and tetrahydrophthalic acid.

Specific examples of the aromatic polycarboxylic acids include, but are not limited to, aromatic polycarboxylic acids having 8 to 12 carbon atoms such as phthalic acid and trimellitic acid.

Examples of the hydroxycarboxylic acids include, but are not limited to, hydroxymonocarboxylic acids and hydroxypolycarboxylic acids.

Examples of the hydroxymonocarboxylic acids include, but are not limited to, aliphatic hydroxymonocarboxylic acids and aromatic hydroxymonocarboxylic acids.

Specific examples of the aliphatic hydroxymonocarboxylic acids include, but are not limited to, aliphatic hydroxymonocarboxylic acids having 2 to 50 carbon atoms (preferably aliphatic hydroxymonocarboxylic acids having 2 to 34 carbon atoms, more preferably aliphatic hydroxymonocarboxylic acids having 2 to 30 carbon atoms) such as glycolic acid, lactic acid, oxybutyric acid, glyceric acid, 6-hydroxyhexanoic acid, cholic acid, deoxycholic acid, chenodeoxycholic acid, 12-oxochenodeoxycholic acid, glycocholic acid, lithocholic acid, hyodeoxycholic acid, ursodeoxycholic acid, apocholic acid, and taurocholic acid.

Specific examples of the aromatic hydroxymonocarboxylic acids include, but are not limited to, aromatic hydroxymonocarboxylic acids having 7 to 12 carbon atoms such as salicylic acid, oxybenzoic acid, and gallic acid.

Examples of the hydroxypolycarboxylic acids include, but are not limited to, aliphatic hydroxypolycarboxylic acids.

Specific examples of the aliphatic hydroxypolycarboxylic acids include, but are not limited to, aliphatic hydroxypolycarboxylic acids having 2 to 10 carbon atoms such as tartronic acid, tartaric acid, citric acid, and malic acid.

The above carboxylic acids may form a salt, anhydride, or hydrate. In many cases, the carboxylic acids are not forming a salt (in particular a salt with a basic compound, such as an amine salt).

Each of the above carboxyl-group-containing organic compounds can be used alone or in combination with others.

Among the above carboxyl-group-containing organic compounds, hydroxycarboxylic acids such as aliphatic hydroxycarboxylic acids (e.g., aliphatic hydroxymonocarboxylic acids, aliphatic hydroxypolycarboxylic acids) are preferred.

Among the aliphatic hydroxycarboxylic acids, alicyclic hydroxycarboxylic acids (i.e., hydroxycarboxylic acids having an alicyclic backbone) are preferred.

Among the alicyclic hydroxycarboxylic acids (i.e., hydroxycarboxylic acids having an alicyclic backbone), alicyclic hydroxycarboxylic acids having 6 to 34 carbon atoms, such as cholic acid, are preferred; alicyclic hydroxycarboxylic acids having 10 to 34 carbon atoms are more preferred; and alicyclic hydroxycarboxylic acids having 16 to 30 carbon atoms are most preferred.

In addition, polycyclic aliphatic hydroxycarboxylic acids, such as cholic acid, and polycyclic aliphatic carboxylic acids, such as dehydrocholic acid and cholanic acid, are preferred since they exert a large effect of suppressing aggregation of silver particles due to their bulky structures.

Examples of the polycyclic aliphatic hydroxycarboxylic acids include condensed polycyclic aliphatic hydroxycarboxylic acids, preferably condensed polycyclic aliphatic hydroxycarboxylic acids having 10 to 34 carbon atoms, more preferably condensed polycyclic aliphatic hydroxycarboxylic acids having 14 to 34 carbon atoms, and particularly preferably condensed polycyclic aliphatic hydroxycarboxylic acids having 18 to 30 carbon atoms.

Examples of the polycyclic aliphatic carboxylic acids include condensed polycyclic aliphatic carboxylic acids, preferably condensed polycyclic aliphatic carboxylic acids having 10 to 34 carbon atoms, more preferably condensed polycyclic aliphatic hydroxycarboxylic acids having 14 to 34 carbon atoms, and particularly preferably condensed polycyclic aliphatic carboxylic acids having 18 to 30 carbon atoms.

Preferably, the carboxyl-group-containing organic compound has a number average molecular weight of 1,000 or less, more preferably 800 or less, and most preferably 600 or less. Preferably, the carboxyl-group-containing organic compound has a pKa value of 1 or more, more preferably 2 or more, and most preferably from 2 to 8. The number average molecular weight can be measured by gel permeation chromatography (GPC).

Polymeric Dispersant

In the present disclosure, the protection colloids preferably comprise a combination of the carboxyl-group-containing organic compound and a polymeric dispersant. In a case in which the protection colloids comprise such a combination, the silver colloids contain a remarkably small number of coarse silver particles. In particular, by the use of a specific combination of the carboxyl-group-containing organic compound and a polymeric dispersant as the protection colloids, the proportion of silver in the silver colloids can be increased even though the amount of coarse silver particles is small, thereby improving storage stability of the silver colloids (and a liquid dispersion thereof).

Examples of the polymer dispersant include, but are not limited to, styrene resins, acrylic resins, water-soluble urethane resins, water-soluble acrylic urethane resins, water-soluble epoxy resins, water-soluble polyester resins, cellulose derivatives, polyvinyl alcohols, polyalkylene glycols, natural polymers, polyethylene sulfonates, and formalin condensates of naphthalenesulfonic acid. Each of the above polymeric dispersants may be used alone or in combination with others.

Specific examples of the styrene resins include, but are not limited to, styrene-(meth)acrylic acid copolymers and styrene-maleic anhydride copolymers.

Specific examples of the acrylic resins include, but are not limited to, methyl (meth)acrylate-(meth)acrylic acid copolymers.

Specific examples of the cellulose derivatives include, but are not limited to: nitrocellulose; alkyl celluloses such as ethyl cellulose: alkyl hydroxyalkyl celluloses such as ethyl hydroxyethyl cellulose; hydroxyalkyl celluloses such as hydroxyethyl cellulose and hydroxypropyl cellulose; and cellulose ethers such as carboxyalkyl celluloses such as carboxymethyl cellulose.

Specific examples of the polyalkylene glycols include, but are not limited to, gelatin and dextrin.

Specific examples of the natural polymers include, but are not limited to, polyethylene glycol and polypropylene glycol in a liquid state.

Representative examples of the polymeric dispersant (i.e., amphiphilic polymeric dispersants) include resins (or water-soluble resins and water-dispersible resins) containing a hydrophilic unit (or hydrophilic block) comprising a hydrophilic monomer.

Examples of the hydrophilic monomer include, but are not limited to: addition polymerizable monomers such as carboxyl-group-containing or acid-anhydride-group-containing monomers and hydroxyl-group-containing monomers; and condensation polymerizable monomers such as alkylene oxides (e.g., ethylene oxide).

Specific examples of the acid-anhydride-group-containing monomers include, but are not limited to: (meth)acrylic monomers such as acrylic acid and methacrylic acid; unsaturated polycarboxylic acids such as maleic acid; and maleic anhydride.

Specific examples of the hydroxyl-group-containing monomers include, but are not limited to: hydroxyalkyl (meth)acrylates such as 2-hydroxyethyl (meth)acrylate; and vinylphenol.

The condensation polymerizable monomers may form a hydrophilic unit through a reaction with an active group such as hydroxyl group (e.g., the hydroxyl-group-containing monomer).

Each of the above hydrophilic monomers may form a hydrophilic unit alone or in combination with others.

The polymeric dispersant includes at least a hydrophilic unit (or hydrophilic block). The polymeric dispersant may comprise either a homopolymer or copolymer of the above hydrophilic monomers (e.g., polyacrylic acid and a salt thereof). Alternatively, the polymeric dispersant may comprise a copolymer of a hydrophilic monomer and a hydrophobic monomer, such as the above-exemplified styrene resins and acrylic resins.

Specific examples of the hydrophobic monomers (non-ionic monomers) include, but are not limited to: (meth) acrylic monomers such as (meth)acrylic acid esters; styrene monomers such as styrene, α-methylstyrene, and vinyltoluene; olefin monomers having 2 to 20 α-carbon atoms; and vinyl carboxylate monomers such as vinyl acetate and vinyl butyrate.

Each of these hydrophobic monomers may form a hydrophobic unit alone or in combination with others.

Specific examples of the (meth)acrylic acid esters include, but are not limited to: (meth)acrylates having C1-C20 alkyl groups such as methyl (meth)acrylate, ethyl (meth)acrylate, n-butyl (meth)acrylate, 2-ethylhexyl (meth)acrylate, lauryl (meth)acrylate, and stearyl (meth)acrylate; cycloalkyl (meth)acrylates such as cyclohexyl (meth)acrylate; aryl (meth)acrylates such as phenyl (meth)acrylate; and aralkyl (meth)acrylates such as benzyl (meth)acrylate and 2-phenylethyl (meth)acrylate.

Specific examples of the olefin monomers having 2 to 20 α-carbon atoms include, but are not limited to, ethylene, propylene, 1-butene, isobutylene, 1-hexene, 1-octene, and 1-dodecene.

In a case in which the polymeric dispersant comprises a copolymer (e.g., a copolymer of a hydrophilic monomer and a hydrophobic monomer), the copolymer may be any of a random copolymer, an alternating copolymer, a block copolymer (e.g., a copolymer comprising a hydrophilic block comprising a hydrophilic monomer and a hydrophobic block comprising a hydrophobic monomer), and a comb-like copolymer (or a comb-like graft copolymer).

The block copolymer may take a diblock structure or a triblock structure (e.g., ABA type, BAB type). With respect to the comb-like copolymer, the main chain thereof may comprise any of the hydrophilic block, the hydrophobic block, and both of the hydrophilic block and the hydrophobic block.

The hydrophilic unit may comprise a condensed block, such as a hydrophilic block comprising an alkylene oxide (e.g., ethylene oxide), such as a polyalkylene oxide (e.g., polyethylene oxide, polyethylene oxide-polypropylene oxide).

The hydrophilic block (e.g., polyalkylene oxide) and the hydrophobic block (e.g., polyolefin block) may be bound to each other via a linking group such as ester bond, amide bond, ether bond, and urethane bond.

Such a bond may be formed by modifying the hydrophobic block (e.g., polyolefin) with a modifying agent and introducing the hydrophilic block thereto.

Specific examples of the modifying agent include, but are not limited to, unsaturated carboxylic acids and anhydrides thereof (e.g., maleic acid and maleic anhydride), lactam or aminocarboxylic acid, hydroxylamine, and diamine.

The comb-like copolymer (the main chain of which comprising the hydrophobic block) may be formed by reacting (or binding) a polymer obtained from a monomer containing a hydrophilic group such as hydroxyl group and carboxyl group (e.g., a hydroxyalkyl (meth)acrylate) with the above-described condensation polymerizable hydrophilic monomer (e.g., ethylene oxide).

In addition, a hydrophilic nonionic monomer can be copolymerized together for balancing hydrophilicity and hydrophobicity.

Specific examples of such copolymerizable components include, but are not limited to, monomers and oligomers comprising an alkyleneoxy unit (preferably ethyleneoxy unit), such as 2-(2-methoxyethoxy)ethyl (meth)acrylate and polyethylene glycol monomethacrylate (having a number average molecular weight of about 200 to 1,000).

Alternatively, the balance between hydrophilicity and hydrophobicity may be adjusted by modifying (e.g., esterifying) the hydrophilic group (e.g., carboxyl group).

The polymeric dispersant may contain a functional group. Specific examples of the functional group include, but are not limited to, acid groups (e.g., acidic groups such as carboxyl group and acid anhydride group thereof, and sulfo groups such as sulfonic acid group) and hydroxyl group. Each of these functional groups may be contained in the polymeric dispersant alone or in combination with others.

In particular, the polymeric dispersant preferably contains an acid group, more preferably carboxyl group.

In a case in which the polymeric dispersant contains acid groups (e.g., carboxyl groups), a part or all of the acid groups (e.g., carboxyl groups) may form a salt (e.g., amine salt, metal salt). In particular, polymeric dispersants in which most acid groups (e.g., carboxyl groups) are not forming salts, i.e., polymeric dispersants containing free acid groups (e.g. carboxyl groups), are preferable. More particularly, polymeric dispersants in which all the acid groups (e.g., carboxyl groups) are not forming salts (e.g., amine salts) with a basic compound (e.g., amine) are preferable.

Preferably, the polymeric dispersant having an acid group (preferably carboxyl group) has an acid value of from 1 to 100 mgKOH/g, more preferably from 3 to 90 mgKOH/g, much more preferably from 5 to 80 mgKOH/g, and most preferably from 7 to 70 mgKOH/g. The polymeric dispersant having an acid group may have an amine value of 0 mgKOH/g (or substantially 0 mgKOH/g).

The positions of the functional groups in the polymeric dispersant are not limited. The functional groups may be present either in the main chain, a side chain, or both the main chain and a side chain of the polymeric dispersant.

The functional group may be of a functional group derived from a hydrophilic monomer or hydrophilic unit, such as hydroxyl group. The functional group may be introduced to the polymer by copolymerizing a copolymerizable monomer having the functional group, such as maleic anhydride.

Each of the above polymeric dispersants may be used alone or in combination with others.

Specific examples of the polymeric dispersant further include a polymeric pigment dispersant described in JP-2004-207558-A.

The polymeric dispersant may be either synthesized products or commercially available products.

Specific examples of commercially available polymeric dispersants (including amphiphilic dispersants) include, but are not limited to: SOLSPERSE series, such as SOLSPERSE 13240, SOLSPERSE 13940, SOLSPERSE 32550, SOLSPERSE 31845, SOLSPERSE 24000, SOLSPERSE 26000, SOLSPERSE 27000, SOLSPERSE 28000, and SOLSPERSE 41090, products of AVECIA GROUP; DISPERBYK series, such as DISPERBYK 160, DISPERBYK 161, DISPERBYK162, DISPERBYK 163, DISPERBYK 164, DISPERBYK 166, DISPERBYK 170, DISPERBYK 180, DISPERBYK 182, DISPERBYK 184, DISPERBYK 190, DISPERBYK 191, DISPERBYK 192, DISPERBYK 193, DISPERBYK 194, DISPERBYK 2001, and DISPERBYK 2050, products of BYK-Chemie GmbH; EFKA-46, EFKA-47, EFKA-48, EFKA-49, EFKA-1501, EFKA-1502, EFKA-4540, EFKA-4550, POLYMER 100, POLYMER 120, POLYMER 150, POLYMER 400, POLYMER 401, POLYMER 402, POLYMER 403, POLYMER 450, POLYMER 451, POLYMER 452, and POLYMER 453, products of BASF (formerly EFKA Chemicals B.V.); AJISPER series, such as AJISPER PB711, AJISPER PA111, AJISPER PB811, AJISPER PB821, and AJISPER PW911, products of Ajinomoto Co., Inc.; FLOWLEN series, such as FLOWLEN DOPA-158, FLOWLEN DOPA-22, FLOWLEN DOPA-17, FLOWLEN TG-700, FLOWLEN TG-720W, FLOWLEN-730W, FLOWLEN-740W, and FLOWLEN-745W, products of Kyoeisha Chemical Co., Ltd.; and JONCRYL series, such as JONCRYL 678, JONCRYL 679, and JONCRYL 62, products of BASF (formerly Johnson Polymer).

Among these polymeric dispersants, DISPERBYK 190 and DISPERBYK 194 each have an acid group.

Preferably, the number average molecular weight of the polymer dispersant is from 1,500 to 100,000, more preferably 2,000 to 80,000, much more preferably from 3,000 to 50,000, and particularly preferably from 7,000 to 20,000.

In recent years, silver colloid liquids are commercially available from a lot of manufacturers and are applicable to inks by the ink preparation method described above.

Color Ink Applying Process and Color Ink Applying Device

The image recording method of the present embodiment may include a color ink applying process.

In the color ink applying process, a color ink containing a colorant is applied to a recording medium. The color ink applying process is performed by a color ink applying device.

The color ink applying process may be performed by applying the color ink to the recording medium by, for example, a bar coater or an inkjet head.

Examples of the color ink applying device include, but are not limited to, a bar coater and an inkjet head.

Color Ink

The color ink contains a colorant other than the metallic pigment, and may optionally contain a solvent, a resin, a surfactant, a defoamer, a fungicide, a preservative, a corrosion inhibitor, and/or a pH adjuster, if needed.

The color ink containing a colorant other than the metallic pigment is clearly distinguished from the metallic ink containing the metallic pigment. Examples of the color ink include, but are not limited to, achromatic color inks such as black ink and white ink, and chromatic color inks such as yellow ink, magenta ink, and cyan ink.

As the color ink is applied, various metallic colors other than silver can be reproduced.

Examples of the solvent include, but are not limited to, organic solvents and water.

Specific examples of these additives, such as the organic solvent, water, resin, surfactant, defoamer, fungicide, preservative, and pH adjuster, include those exemplified as additives for the treatment liquid.

The effects of these additives, contents of these additives, and properties of the color ink are also the same as those for the treatment liquid.

Colorant

Examples of the colorant include, but are not limited to, pigments and dyes.

Usable pigments include both inorganic pigments and organic pigments. Each of these can be used alone or in combination with others. Mixed crystals can also be used as the colorant.

Usable pigments include black pigments, yellow pigments, magenta pigments, cyan pigments, white pigments, green pigments, and orange pigments.

Specific examples of the inorganic pigments include, but are not limited to, titanium oxide, iron oxide, calcium carbonate, barium sulfate, aluminum hydroxide, Barium Yellow, Cadmium Red, Chrome Yellow, and carbon black produced by a known method such as a contact method, a furnace method, and a thermal method.

Specific examples of the organic pigments include, but are not limited to, azo pigments, polycyclic pigments (e.g., phthalocyanine pigments, perylene pigments, perinone pigments, anthraquinone pigments, quinacridone pigments, dioxazine pigments, indigo pigments, thioindigo pigments, isoindolinone pigments, quinophthalone pigments), dye chelates (e.g., basic dye chelate, acid dye chelate), nitro pigments, nitroso pigments, and aniline black. Among these pigments, those having good affinity for solvents are preferred. In addition, resin hollow particles and inorganic hollow particles can also be used.

Specific examples of pigments used for black-and-white printing include, but are not limited to: carbon blacks (i.e., C.I. Pigment Black 7) such as furnace black, lamp black, acetylene black, and channel black; metals such as copper, iron (i.e., C.I. Pigment Black 11), and titanium oxide; and organic pigments such as aniline black (i.e., C.I. Pigment Black 1).

Specific examples of pigments used for color printing include, but are not limited to: C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red 1, 2, 3, 5, 17, 22, 23, 31, 38, 48:2 (Permanent Red 2B(Ca)), 48:3, 48:4, 49:1, 52:2, 53:1, 57:1 (Brilliant Carmine 6B), 60:1, 63:1, 63:2, 64:1, 81, 83, 88, 101 (red iron oxide), 104, 105, 106, 108 (cadmium red), 112, 114, 122 (quinacridone magenta), 123, 146, 149, 166, 168, 170, 172, 177, 178, 179, 184, 185, 190, 193, 202, 207, 208, 209, 213, 219, 224, 254, and 264; C. I. Pigment Violet I (rhodamine lake), 3, 5:1, 16, 19, 23, and 38; C.I. Pigment Blue 1, 2, 15 (phthalocyanine blue), 15:1, 15:2, 15:3, 15:4 (phthalocyanine blue), 16, 171, 56, 60, and 63; and C.I. Pigment Green 1, 4, 7, 8, 10, 17, 18, and 36.

The dyes are not particularly limited, and acid dyes, direct dyes, reactive dyes, and basic dyes can be used. Each of these can be used alone or in combination with others.

Specific examples of the dyes include, but are not limited to, C.I. Acid Yellow 17, 23, 42, 44, 79, and 142, C. I. Acid Red 52, 80, 82, 249, 254, and 289, C.I. Acid Blue 9, 45, and 249, C.I. Acid Black 1, 2, 24, and 94, C. I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The proportion of the colorant in the ink is preferably from 0.1% to 15% by mass, more preferably from 1% to 10% by mass, for improving image density, fixability, and discharge stability.

The pigment can be dispersed in the ink by any of the following methods: introducing a hydrophilic functional group to the pigment to make the pigment self-dispersible; covering the surface of the pigment with a resin; and dispersing the pigment by a dispersant.

In the method of introducing a hydrophilic functional group to the pigment to make the pigment self-dispersible, for example, a functional group such as sulfone group and carboxyl group may be introduced to the pigment (e.g., carbon) to make the pigment dispersible in water.

In the method of covering the surface of the pigment with a resin, for example, the pigment may be incorporated in a microcapsule to make the pigment self-dispersible in water. This pigment may be referred to as a resin-covered pigment. In this case, not all the pigment particles included in the ink should be covered with a resin. It is possible that a part of the pigment particles is not covered with any resin or partially covered with a resin.

In the method of dispersing the pigment by a dispersant, low-molecular dispersants and high-molecular dispersants, represented by known surfactants, may be used.

More specifically, any of anionic surfactants, cationic surfactants, amphoteric surfactants, and nonionic surfactants may be used as the dispersant depending on the property of the pigment.

For example, a nonionic surfactant RT-100 (product of Takemoto Oil & Fat Co., Ltd.) and sodium naphthalene-sulfonate formalin condensate are preferably used as the dispersant. Each of the above dispersants may be used alone or in combination with others.

Pigment Dispersion

The ink can be obtained by mixing a pigment with other materials such as water and an organic solvent. The ink can also be obtained by, first, preparing a pigment dispersion by mixing a pigment with water, a dispersant, etc., and thereafter mixing the pigment dispersion with other materials such as water and an organic solvent.

The pigment dispersion can be obtained by mixing water, a pigment, a pigment dispersant, and other components, if any, to disperse the pigment, and adjusting the particle diameter of the pigment. Preferably, the dispersing is performed by a disperser.

The particle diameter of the pigment dispersed in the pigment dispersion is not particularly limited, but the number-based maximum frequency particle diameter is preferably in the range of from 20 to 500 nm, more preferably from 20 to 150 nm, for improving dispersion stability of the pigment and discharge stability and image quality (e.g., image density) of the ink. The particle diameter of the pigment can be measured using a particle size analyzer (NANOTRAC WAVE-UT151, product of MicrotracBEL Corp.).

The proportion of the pigment in the pigment dispersion is not particularly limited and can be suitably selected to suit to a particular application, but is preferably from 0.1% to 50% by mass, more preferably from 0.1% to 30% by mass, for improving discharge stability and enhancing image density.

Preferably, the pigment dispersion is subjected to filtration using a filter or a centrifugal separator to remove coarse particles, followed by degassing.

Print Layer Containing Silver A print layer containing silver is formed by applying the silver ink to a recording medium to which the treatment liquid has been applied.

A print layer containing silver ("silver-containing print layer") contains silver as a main component. The water, solvent, amines, and dispersing agent contained in the silver ink may remain in the silver-containing print layer. Further, it is preferable that the silver-containing print layer contain a resin, so that scratch resistance and metallic luster of the recorded matter are improved.

The proportion of the resin in the silver-containing print layer is preferably in the range of from 0.2% to 50.0% by mass, and more preferably from 1.0% to 10.0% by mass. When the proportion is from 0.2% to 50.0% by mass, the resin can sufficiently exhibit its function to provide excellent scratch resistance and metallic luster.

The silver-containing print layer is preferably formed on the porous layer.

Layer Thickness of Silver-Containing Print Layer

The layer thickness of the silver-containing print layer refers to an average layer thickness measured after the layer has been dried. The layer thickness of the silver-containing print layer is preferably in the range of from 50 to 300 nm, so that recorded matter having excellent metallic luster and image clarity can be obtained. In the present disclosure, a print surface refers to a surface of a print layer. When the layer thickness of the silver-containing print layer is from 50 to 300 nm, brown color tone derived from plasmon absorption as metal particles is low, and metallic luster and image clarity are improved. In addition, it becomes possible for the porous layer to immediately absorb the vehicle of the ink containing silver, and the metallic luster and the image clarity are improved. The layer thickness needs to be equal to or greater than the particle diameter of one silver particle, since metal-like image clarity is intrinsically exhibited as an interaction between adjacent silver particles arranged in the horizontal direction is increased. In addition, within a range equal to or less than the particle diameter of eight silver particles, it becomes possible for the porous layer to immediately absorb or adsorb the vehicle of the ink containing silver, and the metallic luster and the image clarity are improved.

b* Value

For securing a silver-color print surface having high image clarity, the b* value is preferably in the range of from −7 to +4. As the b* value becomes more minus, bluish color becomes stronger. As the b* value becomes more plus, yellowish color becomes stronger.

As yellowish color becomes stronger, the color of the ink containing silver particles approaches gold color. When the b* value exceeds +4, gold color strongly appears and the color tone becomes far from silver color. When the b* value falls below −7, bluish color becomes stronger and the color tone becomes darker and different from silver color. The b* value can be easily measured with a spectrophotometer.

Print Layer Containing Colorant Other than Silver

The average thickness of a print layer containing a colorant other than silver (i.e., a print layer of the color ink) is preferably from 1 to 300 nm, and more preferably from 2 to 250 nm. In particular, when toning with silver color, the average thickness is particularly preferably from 3 to 100 nm so as not to conceal the silver color. By toning within this range, a colored metallic image can be obtained and a print surface with good texture both in image clarity and color tone can be obtained. It is preferable that toning be performed by printing with the silver ink first and subsequently printing with the color ink on a part which has been printed with the silver ink.

Measurement of Layer Thickness of Print Layer

The layer thickness of the silver-containing print layer or the print layer containing a colorant other than silver can be measured by cutting the printed matter and observing a cross-section thereof with a microscope, such as optical microscope, laser microscope, scanning electron microscope (SEM), and transmission electron microscope (TEM).

Recording Medium

The recording medium is not particularly limited as long as a porous layer can be formed on a surface thereof with the treatment liquid according to the present embodiment. For example, plain paper, gloss paper, special paper, and cloth can be used. Also, impermeable substrates can be used to form good quality images. An absorbing layer (e.g., porous layer) may or may not be formed in advance on the surface of the recording medium.

In particular, according to the present embodiment, an image having excellent image clarity and metallic luster can be formed even on such an impermeable substrate having no ink absorbing layer (e.g., porous layer), providing compatibility for a wide variety of recording media.

The impermeable substrate refers to a substrate having a surface with a low level of moisture permeability and absorptivity. Examples thereof include a material having a number of hollow spaces inside but not open to the exterior. To be more quantitative, the impermeable substrate refers to a substrate that absorbs water in an amount of 10 mL/m$^2$ or less from the start of contact to 30 msec$^{1/2}$ after the start of contact, when measured according to the Bristow method.

Specific preferred examples of the impermeable substrate include, but are not limited to, plastic films such as vinyl chloride resin films, polyethylene terephthalate (PET) films, polypropylene films, polyethylene films, and polycarbonate films. The effect of the present invention is remarkably exerted with these plastic films, because they are generally not porous on the surface so that gloss and image clarity of the silver ink are difficult to obtain.

The recording medium is not limited to articles used as typical recording media. Examples of articles usable as the recording medium include: building materials such as wall paper, floor material, and tile; cloth for apparel such as T-shirt; textile; and leather. In addition, by adjusting the configuration of paths through which the recording medium is conveyed, ceramics, glass, and metals may be used as the recording medium.

Commercially available recording media having porous layers in advance can also be used as the recording medium. Specific examples of such commercially available recording media include, but are not limited to; IJ FILM RM-1GP01 (having an average pore diameter of 230 nm), product of Ricoh Co., Ltd.; NB-WF-3GF100 (having an average pore diameter of 210 nm) and NB-RC-3GR120 (having an average pore diameter of 250 nm), products of Mitsubishi Paper Mills Limited; PT-201A420 (having an average pore diameter of 270 nm), SD-101A450 (having an average pore diameter of 250 nm), GL-101A450 (having an average pore diameter of 240 nm), GP501 A450 (having an average pore diameter of 250 nm), SP-101A450 (having an average pore diameter of 210 nm), PT-101A420 (having an average pore diameter of 240 nm), and PR101 (having an average pore diameter of 270 nm), products of Canon Inc.; EJK-QTNA450 (having an average pore diameter of 200 nm), EJK-EPNA450 (having an average pore diameter of 210 nm), EJK-CPNA450 (having an average pore diameter of 220 nm), EJK-RCA450 (having an average pore diameter of 240 nm), EJK-OGNA450 (having an average pore diameter of 190 nm), EJK-GANA450 (having an average pore diameter of 180 nm), EJK-NANA450 (having an average pore diameter of 170 nm), and EJK-EGNA450 (having an average pore diameter of 200 nm), products of ELECOM CO., LTD.; WPA455VA (having an average pore diameter of 200 nm), WPA450PRM (having an average pore diameter of 210 nm), G3A450A (having an average pore diameter of 220 nm), G3A450A (having an average pore diameter of 210 nm), and WPA420HIC (having an average pore diameter of 280 nm), products of FUJIFILM Corporation; KA420SCKR (having an average pore diameter of 240 nm), KA450PSKR (having an average pore diameter of 230 nm), and KA450SLU (having an average pore diameter of 210 nm), products of SEIKO EPSON CORPORATION; and BP71GAA4 (having an average pore diameter of 220 nm), product of Brother Industries, Ltd.

Scratch Resistance of Ink Containing Silver

By providing a transparent resin layer (hereinafter may be referred to as "laminate layer") on an image formed of the silver-containing print layer by applying the treatment liquid and the ink containing silver to a recording medium, scratch resistance can be improved.

The transparent resin layer may also be provided on a print layer formed by applying the color ink containing a colorant other than silver on the silver-containing print layer formed by applying the ink containing silver to the recording medium.

Laminate Layer Forming Process and Laminate Layer Forming Device

In a laminate layer forming process, a laminate layer is further formed on a region to which the silver ink has been applied in the silver ink applying process. The laminate layer forming process is performed by a laminate layer forming device.

The laminate layer formed on the print layer comprises a resin. Preferably, the resin is highly transparent. Specific examples of such a resin include, but are not limited to, polyethylene terephthalate (PET) and polypropylene (PP). In addition, nylon may also be used as the resin. The surface of the print layer or the printed matter as a whole is preferably covered with such a resin by a lamination treatment. Alternatively, an overcoat treatment is also preferred in which a water solution or solvent solution of a transparent resin is applied thereto.

The laminate layer forming process can be formed by, for example, blade coating, gravure coating, bar coating, roll coating, dip coating, curtain coating, slide coating, die coating, or spray coating.

Examples of the laminate layer forming device include, but are not limited to, a bar coater and a pressure bonding roller.

The average thickness of the resin layer formed on the print layer is preferably 5 to 300 μm. When the average thickness of the resin layer is 5 μm or more, scratch resistance and durability as a coating film are excellent. The resin layer is unlikely to be damaged or broken, exerting effects as the coating film. When the average thickness of the resin layer is 300 μm or less, high image clarity is achieved, the b* value is 4 or less, and the color toner is excellent.

It is preferable that the laminate layer be formed by coating the printed part of the printed matter or the entire printed matter with a resin film, then heating it, or coating it by pressure bonding without applying heat. It is more preferable that the print surface or the entire printed matter be coated by a lamination treatment.

Alternatively, an overcoat treatment is also preferred in which a water solution or solvent solution of a transparent resin is applied thereto in place of the lamination treatment.

Recorded Matter

The recorded matter according to an embodiment of the present invention comprises a recording medium, a porous layer on the recording medium, and a metallic layer on the porous layer. It is preferable that the recorded matter have multiple droplet marks that are porous when observed with a scanning electron microscope from the image-formed-surface side. It is also preferable that the recording medium be an impermeable substrate. The recorded matter may further contain a pigment other than metallic pigment on the porous layer.

The recorded matter may be manufactured by an inkjet image recording apparatus and an inkjet image recording method.

Droplet Marks

When the porous layer is formed by an inkjet method, multiple droplet marks formed by ink droplets are observed in the porous layer. Therefore, the porous layer can be clearly distinguished from a coating layer, if any, on the recording medium.

Figure 7:
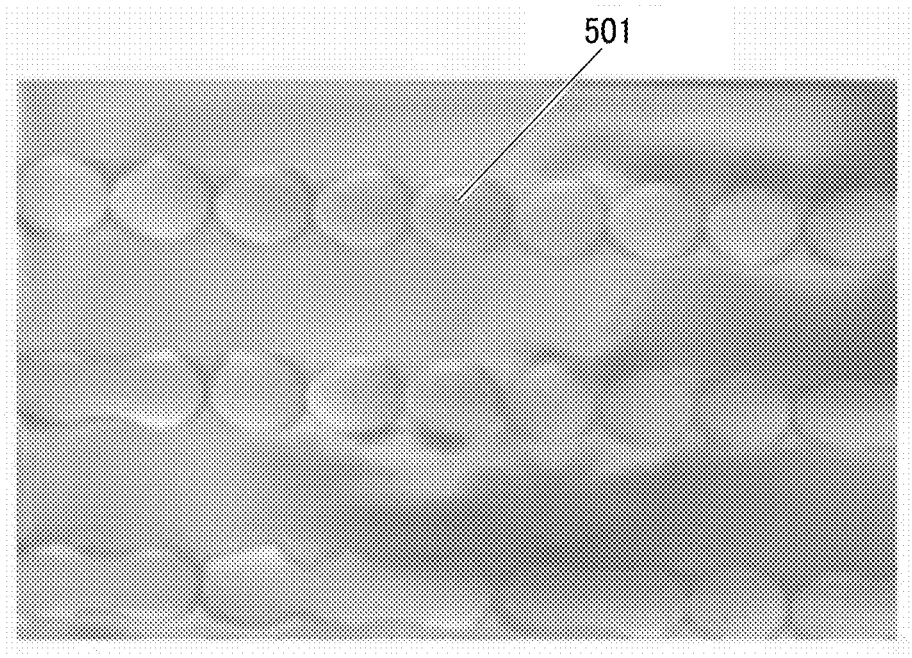
FIG. 7 is a microscopic image of droplet marks observed on a recording medium to which a silver ink has been applied by an inkjet head.

The droplet mark refers to an indentation formed by a droplet discharged from an inkjet head. The droplet mark may be in a circular shape of a droplet or a shape formed by overlapping of droplets. In a case in which a droplet mark is formed by overlapping of droplets, the droplet mark will be a coalesced droplet mark having a rounded end as illustrated in FIG. 7. This is clearly distinguished from a uniform surface formed with a bar coater or the like.

It is to be noted that droplet marks are observed not only when the treatment liquid is applied to a recording medium by an inkjet method but also when the silver ink or the color ink is applied to the recording medium by an inkjet method.

A droplet mark 501 illustrated in FIG. 7 is observed when the silver ink is applied to a recording medium by an inkjet head. Such a droplet marks as illustrated in FIG. 7 is similarly observed when the color ink or the treatment liquid is applied to the recording medium by an inkjet head.

Such droplet marks can be observed by, for example, using a scanning electron microscope (SEM).

Image Recording Method 1: Pre-Jetting Image Recording Method

In the pre-jetting image recording method according to the present embodiment, the treatment liquid is first selectively applied by an inkjet method to a part of a recording medium to which the metallic ink is to be applied, and then the metaric ink is applied by an inkjet method to the recording medium to which the treatment liquid has been applied.

The treatment liquid and the metallic ink may be charged in a head for discharging the treatment liquid and a head for discharging the metallic ink, respectively, which are mounted on the same carriage of a serial-type image recording apparatus. In a case in which the treatment liquid is reactive with metallic ink and/or other color inks, a system that is able to maintain discharge stability so as not to cause nozzle clogging is required.

Image Recording Method 2: Pre-Coating Image Recording Method

In the pre-coating image recording method according to the present embodiment, the treatment liquid is first made to coat a part or the entire of a recording medium using a roller, bar coater, spray, or the like, and then the metallic ink is applied by an inkjet method to the recording medium that has been coated with the treatment liquid.

The area applied with the treatment liquid is larger than the area applied with the metallic ink.

Recording Apparatus and Recording Method

The following description is based on a case in which black (K), cyan (C), magenta (M), and yellow (Y) inks are used, where each of the ink is replaceable with the metallic ink containing the metallic pigment. In addition to these, the treatment liquid is used.

The ink according to an embodiment of the present invention can be suitably applied to various recording apparatuses, such as printers, facsimile machines, photocopiers, multifunction peripherals (having the functions of printer, facsimile machine, and photocopier), and three-dimensional objects forming apparatuses, employing an inkjet recording method.

In the present disclosure, the recording apparatus and the recording method refer to an apparatus capable of discharging inks or various treatment liquids onto a recording medium and a method for recording an image on the recording medium using the apparatus, respectively. The recording medium refers to an article to which the inks or the various treatment liquids can be attached at least temporarily.

The recording apparatus may further optionally include, in addition to an ink discharge head, devices relating to feeding, conveying, and ejecting of the recording medium and other devices referred to as a pretreatment device or an aftertreatment device.

The recording apparatus may further optionally include a heater for use in a heating process and a dryer for use in a drying process. Examples of the heater and the dryer include, but are not limited to, devices for heating and drying the printed surface and the reverse surface of a recording medium. The heater and the dryer are not particularly limited. Specific examples thereof include, but are not limited to, a fan heater and an infrared heater. The heating process and the drying process may be performed either before, during, or after printing.

In addition, the recording apparatus and the recording method are not limited to those producing merely meaningful visible images such as texts and figures with the ink. For example, the recording apparatus and the recording method can produce patterns like geometric design and three-dimensional images.

The recording apparatus includes both a serial-type device in which the discharge head is moved and a line-type device in which the discharge head is not moved, unless otherwise specified.

Furthermore, in addition to a desktop apparatus, the recording apparatus includes an apparatus capable of printing images on a wide recording medium with AO size and a continuous printer capable of using continuous paper reeled up in a roll form as recording media.

Inkjet Recording Method

An inkjet recording method of the present embodiment preferably includes at least an ink discharge process that discharges the metallic ink (hereinafter also referred to as "ink") of the present embodiment onto a recording medium (also referred to as "substrate").

In the ink discharge process, a stimulus is applied to the ink to jet the ink to print an image. An ink jetting device is not particularly limited and can be suitably selected to suit to a particular application. Examples thereof include, but are not limited to, various recording heads (ink discharge heads). In particular, preferred are those having a head having a plurality of nozzle arrays and a sub-tank for accommodating ink supplied from an ink cartridge and supplying the ink to the head. Preferably, the sub-tank includes a negative pressure generator that generates a negative pressure in the sub-tank, an atmospheric releasing device that releases the inside of the sub-tank to the atmosphere, and a detector that detects the presence or absence of ink by a difference in electrical resistance.

The stimulus can be generated by a stimulus generator. The stimulus is not particularly limited and can be suitably selected to suit to a particular application. Examples thereof include, but are not limited to, heat (temperature), pressure, vibration, and light. Each of these may be used alone or in combination with others. Among these, heat and pressure are preferred.

Examples of the stimulus generator include, but are not limited to, a heater, a presser, a piezoelectric element, a vibration generator, an ultrasonic oscillator, and a light source. More specifically, the stimulus generator may be a piezoelectric actuator such as a piezoelectric element; a thermal actuator using phase change of a liquid caused by film boiling, using a thermoelectric conversion element such as a heat element; a shape-memory alloy actuator using a metal phase change caused by temperature change; and an electrostatic actuator using an electrostatic force.

The ink jetting process is not particularly limited and is changed depending on the type of the stimulus. When the stimulus is heat, one possible method includes giving thermal energy which corresponds to a recording signal to the ink in a recording head, from a thermal head, to generate bubbles in the ink, thereby discharging or injecting the ink droplets from nozzles of the recording head by the pressure of the bubbles. When the stimulus is pressure, one possible method includes applying a voltage to a piezoelectric element attached to a pressure chamber disposed in an ink flow path in a recording head, to make the piezoelectric element bend while reducing the volume of the pressure chamber, thereby discharging or injecting the ink droplets from nozzles of the recording head.

Among these, a piezo method that applies a voltage to a piezo element to jet an ink is preferred. The piezo method is advantageous for jetting an ink containing a resin because it does not generate heat. It is an effective method with less nozzle clogging, especially when an ink having a low content of a wetting agent is used. To prevent the occurrence of nozzle missing, it is preferable to perform a dummy scan by applying a voltage to the piezo element that is strong enough not to discharge the ink. Further, it is preferable to perform an operation of discharging the ink to an ink reservoir before reaching a dummy scan for printing one page. Further, it is preferable to dispose a scraper that scrapes off the ink stuck to a dummy discharge receptacle. Preferably, the scraper is either a wiper or a cutter.

Further, a heater may be provided that heats the substrate before or at the time when the ink adheres thereto, for more spreading the discharged ink on the substrate.

The heater may be one or more of known heating devices appropriately selected. Examples of the heating devices include, but are not limited to, forced air heaters, radiant heaters, conduction heaters, high frequency dryers, and microwave dryers. Such a heating device may be either incorporated in or externally attached to an existing inkjet printer.

FIG. 1 is a schematic diagram illustrating an inkjet recording apparatus according to an embodiment of the present invention. Hereinafter, a serial-type (shuttle-type) inkjet recording apparatus equipped with a carriage to scan is described, but the apparatus of the present embodiment may also be applied to a line-type inkjet recording apparatus equipped with a line head.

An apparatus illustrated in FIG. 1 includes: an apparatus body 101; a sheet feeding tray 102 to load sheets (e.g., substrates), attached to the apparatus body 101; a sheet ejection tray 103 to stack sheets having an image thereon, attached to the apparatus body 101; and an ink cartridge loading unit 104. An operation unit 105 is disposed on an upper surface of the ink cartridge loading unit 104. The operation unit 105 includes an operation key and a display. The ink cartridge loading unit 104 includes a front cover 115 that is openable and closable for detaching/attaching an ink cartridge 200 therefrom/thereto. The apparatus further includes a top cover 111 and a front cover 112.

Figure 2:
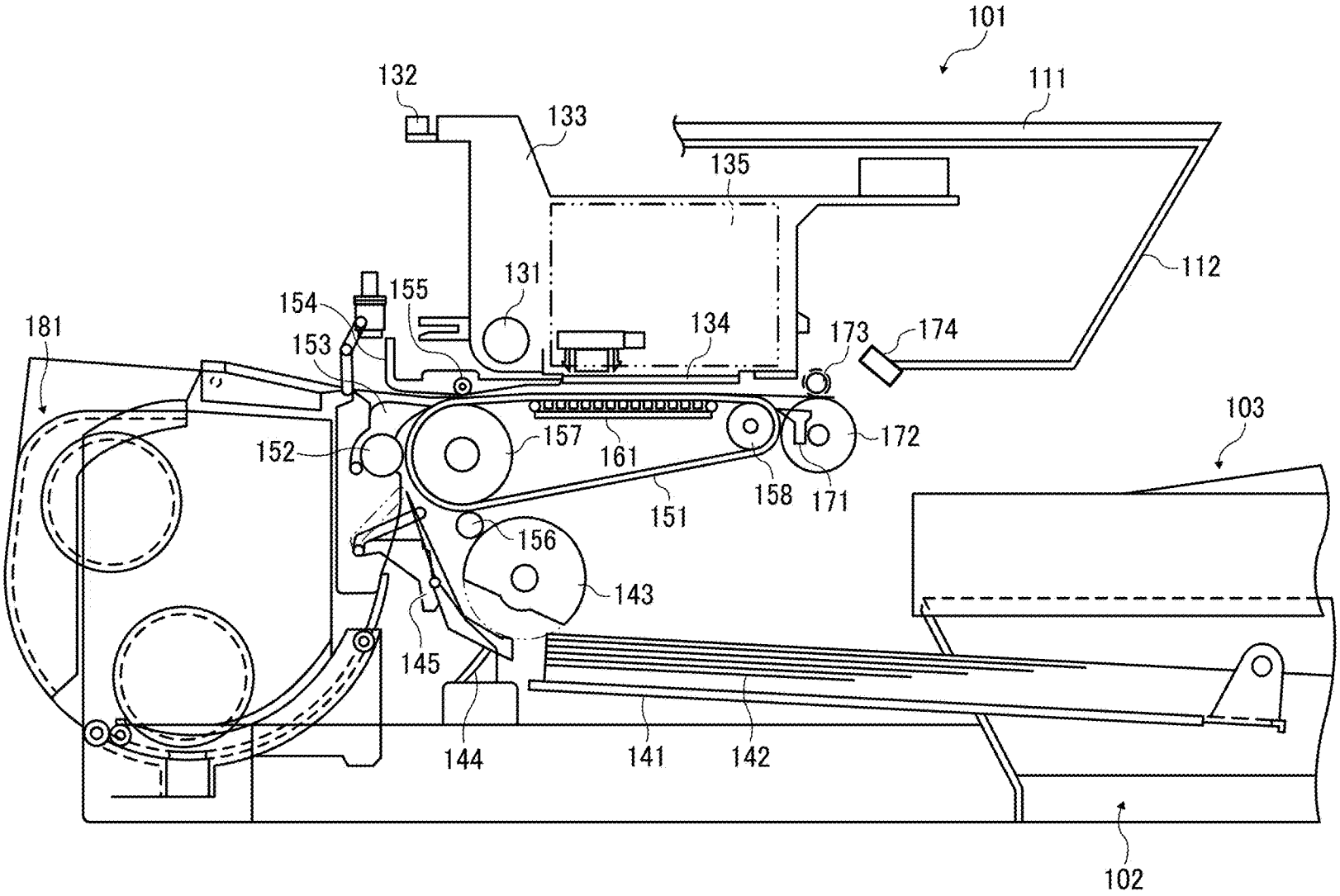
FIG. 2 is a cross-sectional view of an image recording apparatus according to an embodiment of the present invention.

As illustrated in FIG. 2, the apparatus body 101 contains a guide rod 131 and a stay 132 which are guide members horizontally bridging side plates. The guide rod 131 and the stay 132 slidably support a carriage 133 in a main scanning direction. The carriage 133 is moved by a main scanning motor to scan.

The carriage 133 includes a recording head 134 that includes four inkjet heads for discharging droplets of yellow, cyan, magenta, and black inks, respectively, each of which having multiple ink discharge nozzle arrays. The recording head 134 is mounted on the carriage 133 so that the ink droplet discharging direction is downward with the multiple ink discharge nozzle arrays intersecting with the main scanning direction. The silver ink contains silver nano pigments.

Each of the inkjet heads constituting the recording head 134 may include a stimulus generator for discharging ink, such as a piezoelectric actuator such as a piezoelectric element; a thermal actuator using phase change of ink caused by film boiling, using a thermoelectric conversion element such as a heat element: a shape-memory alloy actuator using a metal phase change caused by temperature change; and an electrostatic actuator using an electrostatic force. Further, a heater mechanism for heating the ink in the recording head may also be provided.

The carriage 133 further includes sub tanks 135 for supplying respective color inks to the recording head 134. Each sub tank 135 is filled with the ink supplied from the ink cartridge 200 loaded on the ink cartridge loading unit 104 through an ink supply tube.

The apparatus includes a sheet feeder for feeding sheets 142 stacked on a sheet stacker (pressure plate) 141 of the sheet feeding tray 102. The sheet feeder includes a sheet feeding roller 143 having a semicircular shape and a separation pad 144 made of a material having a large coefficient of friction. The sheet feeding roller 143 separates and feeds the multiple sheets 142 one by one. The separation pad 144 is disposed facing the sheet feeding roller 143 while being biased toward the sheet feeding roller 143.

The apparatus further includes a sheet conveyer for conveying the sheets 142 fed from the sheet feeder at below the recording head 134. The sheet conveyer includes a conveyance belt 151, a counter roller 152, a conveyance guide 153, a pressing member 154, a leading edge pressing roller 155, and a charging roller 156. The conveyance belt 151 conveys each sheet 142 while electrostatically adsorbing the sheet 142. The counter roller 152 conveys the sheet 142 fed from the sheet feeder via a guide 145, while sandwiching the sheet 142 with the conveyance belt 151. The conveyance guide 153 changes the feed direction of the sheet 142 being fed substantially vertically upward by approximately 90 degrees, to make the sheet 142 follow the conveyance belt 151. The leading edge pressing roller 155 is biased toward the conveyance belt 151 by the pressing member 154. The charging roller 156 charges a surface of the conveyance belt 151.

In FIG. 2, a duplex-printing sheet feeding unit 181 is illustrated. However, in the Examples described below, the duplex-printing sheet feeding unit 181 is replaced with a pre-coating device illustrated in FIG. 5A.

The pre-coating device of the present embodiment is connected to a sheet feeder having a function of storing and sequentially supplying sheets (e.g., recording media used for printing) and to a printer that forms an image by an inkjet method. The sheet is conveyed from the sheet feeder, then the conveyed sheet gets coated with a treatment liquid and set so as to be conveyed to the printer.

Figure 5A:
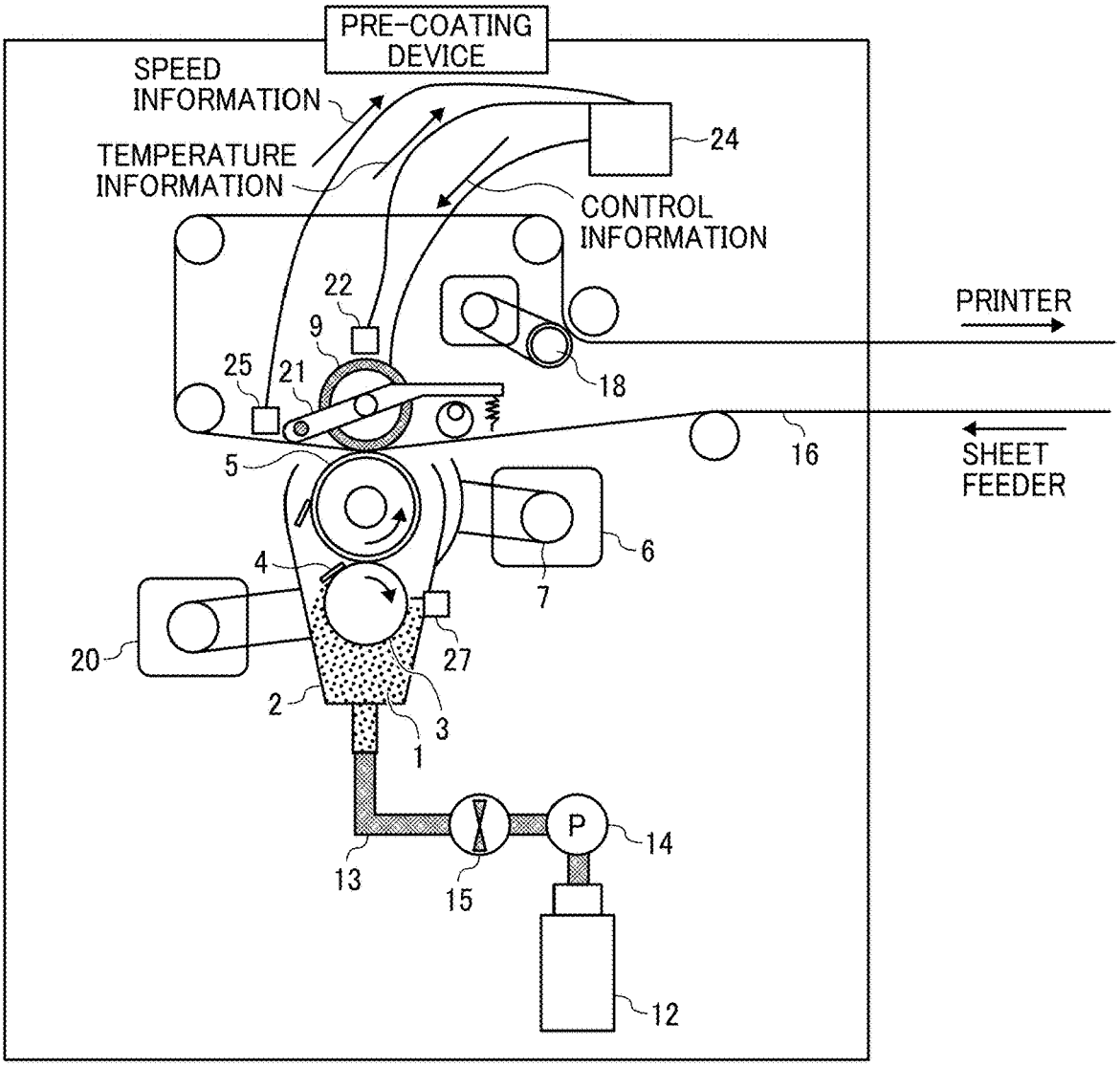
FIG. 5A is a cross-sectional view of a treatment liquid coating device.

Referring to FIG. 5A, the pre-coating device of the present embodiment includes a coating roller 5 that applies a treatment liquid 1 to a sheet 16, a pressure roller 9 that is pressed against and in contact with the coating roller 5, a conveyance roller 18 that conveys the sheet 16, a guide roller 17 that guides the sheet 16 to be conveyed, controller 24 that controls the entire of the device. With this configuration, the treatment liquid 1 in a supply pan 2 can be applied to the sheet 16 from the coating roller 5 via a squeeze roller 3.

Figure 5B:
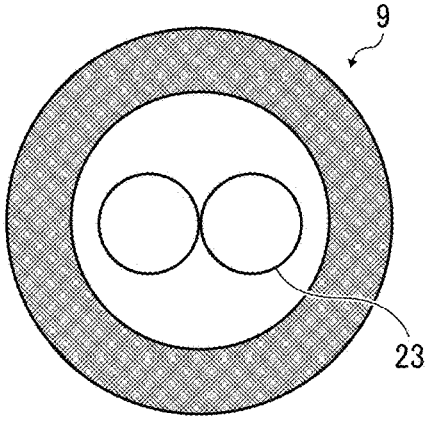
FIG. 5B is a cross-sectional view of a pressure roller 9 illustrated in FIG. 5A.

As illustrated in FIG. 5B, a heater lamp 23 is disposed inside the pressure roller 9 and is controlled by the controller 24 to heat the pressure roller 9. With this configuration, the sheet 16 is heated by the pressure roller 9 that forms a nip with the coating roller 5 when the coating roller 5 applies the treatment liquid 1 to the sheet 16.

The configuration and operation of the pre-coating device of the present embodiment are described in detail below. First, the treatment liquid 1 stored in a cartridge 12 is sucked up by a pump 14 that is an electrically driven ink feeder, such as a tubing pump and a diaphragm pump, and is supplied to the supply pan 2 via a supply channel 13 and a solenoid valve 15. The solenoid valve 15 is an opening/closing device for the supply channel 13, such as a solenoid valve and a ball valve, which are electrically openable and closable.

The amount of the treatment liquid 1 supplied to the supply pan 2 is detected by a liquid level detection sensor 27. When the liquid level detection sensor 27 detects that the amount is below a predetermined threshold value, the solenoid valve 15 opens, and the pump 14 sucks up the fluid from the cartridge 12 and supplies a preset amount of the fluid to the supply pan 2. As the amount of supply of the fluid reaches a preset value, the solenoid valve 15 is closed and the pump 14 is stopped, so that the amount of the fluid in the supply pan 2 is kept constant.

As described above, the solenoid valve 15 opens only when the treatment liquid 1 is supplied, and the operating time thereof is short. Therefore, when a normal-closed-type valve that is closed except when the power is turned on is used as the solenoid valve 15, power consumption can be reduced.

Next, the treatment liquid 1 stored in the supply pan 2 is pumped up as the squeeze roller 3 is driven to rotate by a motor 20. When the squeeze roller 3 is a roller having grooves on its surface, such as an anilox roller and a wire bar, the squeeze roller 3 is less affected by the viscosity of the treatment liquid 1 and the printing speed, at the time of pumping the fluid, leading to easy control of the amount of the fluid.

The treatment liquid 1 pumped up by the squeeze roller 3 is scraped off by a metering blade 4 and carried to a nip point formed with the coating roller 5. Nip points are points where adjacent rollers are pressed against each other and come into contact with each other, and usually arranged so as to be continuous in a straight line in the axial direction of the rollers.

The metering blade 4 may be made of a metal such as steel use stainless (SUS), plastic, or rubber. Among these, plastic materials are preferred in view of wear resistance, excess fluid scraping function, and lifespan of the squeeze roller 3.

The treatment liquid 1 carried to the nip point between the coating roller 5 and the squeeze roller 3 is applied to the coating roller 5 while being uniformly spread in the axial direction between the coating roller 5 and the squeeze roller 3. The peripheral surface of the coating roller 5 is covered with an elastic body, such as rubber, and is driven by a motor 6 via a one-way clutch 7.

The treatment liquid 1 applied to the coating roller 5 is transferred to the sheet 16 at the nip point between the pressure roller 9 and the coating roller 5. The pressure roller 9 is rotatably supported at the center of a swingable arm 21 via a bearing and follows the sheet 16 at the nip.

As illustrated in FIG. 5B, the inside of the pressure roller 9 is hollow, and the heater lamp 23 is incorporated therein. Since the present device is configured to perform application of the treatment liquid and nipping of sheets at the same time, such a configuration in which the heater lamp 23 is incorporated in the pressure roller 9 makes it possible to apply heat only to a region to which the liquid is applied. This makes it possible to heat only the minimum necessary area. Therefore, excessive heating and deformation of the sheets can be prevented. Further, the configuration in which the heater lamp 23 is incorporated in the pressure roller 9 prevents upsizing of the device.

A temperature detection sensor 22 is disposed near the pressure roller 9, and a temperature detection sensor 25 is disposed near the sheets which are immediately after being coated with the treatment liquid. The controller 24 controls the heater lamp 23 based on the temperatures measured by the temperature detection sensors 22 and 25. After the pressure roller 9 has been heated to a predetermined set temperature, the sheet 16 and the coating roller 5 are brought to form a nip to heat the sheet 16.

Thus, the heater lamp 23 functions as a heater that heats the sheet 16 at the contact position with the coating roller 5.

Referring back to FIG. 2, the conveyance belt 151 is an endless belt stretched between a conveyance roller 157 and a tension roller 158. The conveyance belt 151 is capable of circulating in a belt conveying direction. The conveyance belt 151 includes a surface layer (i.e., sheet adsorbing surface) and a back layer (i.e., middle resistance layer, ground layer). The surface layer may include a resin material having a thickness of about 40 μm without resistance control, such as ethylene-tetrafluoroethylene copolymer (ETFE). The back layer includes the same material as the surface layer further including carbon black for resistance control. On the back side of the conveyance belt 151, a guide member 161 is disposed at a position corresponding to a printing area of the recording head 134. Note that a test machine used in the present disclosure is a modified machine in which a film heater is provided to the guide member. The guide member is heated to an arbitrary temperature to heat the recording medium, thus enabling printing.

The apparatus further includes a sheet ejector for ejecting the sheets 142 having the image recorded by the recording head 134 thereon. The sheet ejector includes a separation claw 171 that separates the sheets 142 from the conveyance belt 151, a sheet ejection roller 172, and another sheet ejection roller 173. The sheets 142 are output on the sheet ejection tray 103 disposed below the sheet ejection roller 172 after being dried with hot air from a fan heater 174.

Serial-Type Inkjet Recording Apparatus

Figure 3:
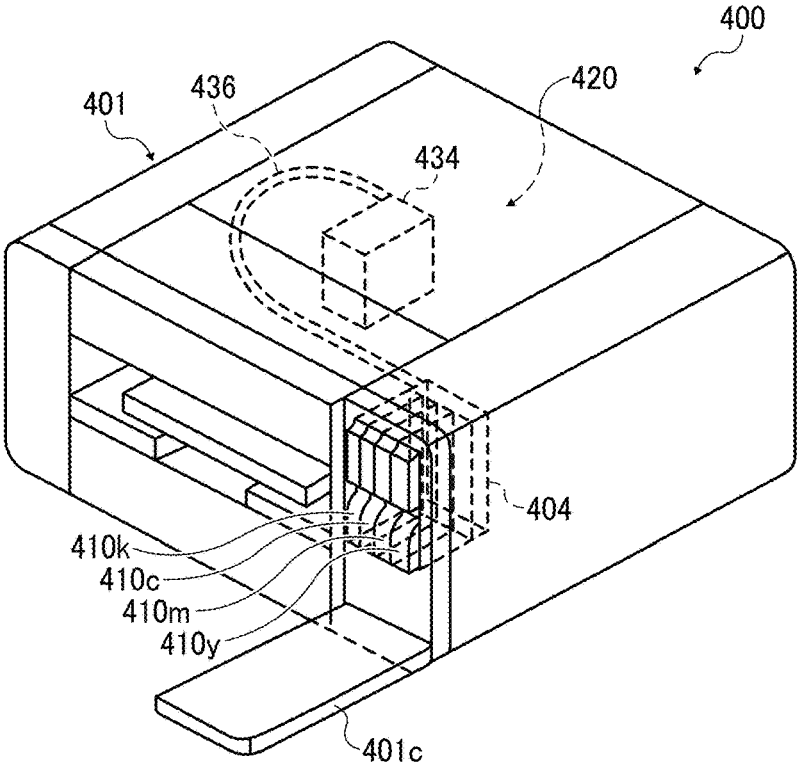
FIG. 3 is a perspective view of another image recording apparatus according to an embodiment of the present invention.
Figure 4:
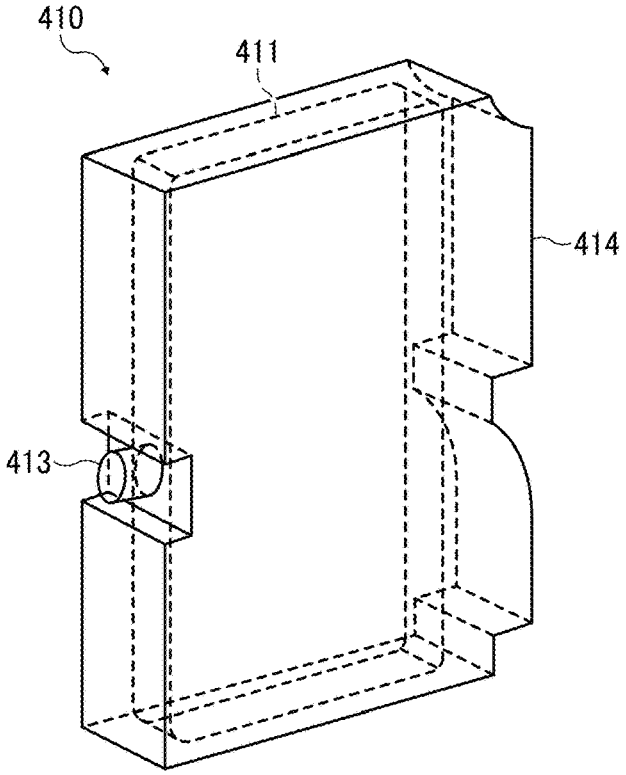
FIG. 4 is a perspective view of a main tank.

One example of the recording apparatus is described in detail below with reference to FIGS. 3 and 4. FIG. 3 is a perspective view of the recording apparatus. FIG. 4 is a perspective view of a main tank. An image recording apparatus 400, as one example of the recording apparatus, is a serial-type image forming apparatus. A mechanical unit 420 is disposed in a housing 401 of the image recording apparatus 400. Main tanks 410*k*, 410*c*, 410*m*, 410*y*, and 410*si* for respective colors of black (K), cyan (C), magenta (M), yellow (Y), and silver (Si) (hereinafter each referred to as "main tank 410") are each equipped with an ink container 411 made of a packaging material such as an aluminum laminate film. The ink container 411 is accommodated in a container casing 414 made of plastic. As a result, the main tank 410 is used as an ink cartridge of each color.

A cartridge holder 404 is disposed on the rear side of the opening when a cover 401*c* of the apparatus body is opened. The main tank 410 is detachably attached to the cartridge holder 404. Thus, each ink discharging outlet 413 of the main tank 410 communicates with a discharge head 434 for each color via a supplying tube 436 for each color so that the ink can be discharged from the discharge head 434 to a recording medium.

The recording apparatus further includes a pretreatment device for applying the treatment liquid, and optionally an aftertreatment device, in addition to an ink discharger.

As an example, the pretreatment device and the aftertreatment device may include a liquid container containing the treatment liquid and an aftertreatment liquid, respectively, and a liquid discharge head to discharge the treatment liquid or aftertreatment liquid by an inkjet recording method, having a similar configuration to the ink discharger for each of the black (K), cyan (C), magenta (M), and yellow (Y) inks.

As another example, the pretreatment device and the aftertreatment device may be provided as a device employing a method other than inkjet recording method, such as blade coating, roll coating, and spray coating.

The ink may be applied not only to inkjet recording but also to other methods in various fields. Specific examples of such methods other than inkjet recording include, but are not limited to, blade coating, gravure coating, bar coating, roll coating, dip coating, curtain coating, slide coating, die coating, and spray coating.

The applications of the ink according to an embodiment of the present invention are not particularly limited and can be suitably selected to suit to a particular application. For example, the ink can be used for printed matter, paints, coating materials, and foundations. Furthermore, the ink can be used not only to form two-dimensional texts and images but also as a material for forming three-dimensional images (i.e., three-dimensional objects).

A three-dimensional object forming apparatuses for forming a three-dimensional object is not particularly limited and well-known apparatuses may be used, such as those equipped with a container, a supplier, a discharger, and a dryer of the ink. The three-dimensional object includes an object produced by re-applying ink over and over. In addition, the three-dimensional object includes a processed product produced by processing a structure including a substrate (such as a recording medium) and an ink applied thereon. The processed product may be produced by subjecting a sheet-like or film-like recorded matter or structural body to a molding processing such as heat stretching processing and punching processing. The processed product is suitably applied to those formed after surface decoration, such as meters and operation panels of automobiles, office automation equipment, electric or electronic devices, and cameras.

In the present disclosure, "image forming", "recording", and "printing" are treated as synonymous terms.

In addition, "recording media", "media", and "print media" are synonyms.

EXAMPLES

Further understanding can be obtained by reference to certain specific examples which are provided herein for the purpose of illustration only and are not intended to be limiting.

Preparation of Treatment Liquid

Preparation of Inorganic Hollow Particle Dispersion 1

In a beaker, 10.0 g of DISPERBYK-2008 (product of BYK, acrylic copolymer having an active ingredient of 60%) were dissolved in 294.0 g of high-purity water. Next, 50.0 g of inorganic hollow particles (SILINAX, product of Nittetsu Mining Co., Ltd., hollow silica having a primary particle diameter of 80 to 130 nm and a silica film thickness of 5 to 15 nm) were added thereto in 10 portions, then stir-mixed and dispersed using an EXCEL AUTO HOMOGENIZER (product of NIHONSEIKI KAISHA LTD.) at 5,000 rpm for 30 minutes until no lump was observed. The number of rotations was gradually increased to 10,000 rpm, then stirring was performed for 30 minutes.

The resulted pigment dispersion liquid was treated using an ultrasonic homogenizer US-300T (with a chip of φ26, product of NIHONSEIKI KAISHA LTD.) for 1 hour at 200 μA while being water-cooled, and filtered with a 5-μm membrane filter (cellulose acetate film). Thus, an inorganic hollow particle dispersion 1 containing 14.1% by mass of inorganic hollow particles was prepared.

Treatment liquids 1 to 12 were prepared according to the descriptions presented in Tables 1-1 and 1-2.

TABLE 1-1

| Category | Treatment Liquid Component | Polarity | Substance/ Product Name | Manufacturer | Primary Particle Diameter | Conc. (% by mass) | Treatment Liquid No. 1 | 2 | 3 | 4 | 5 | 6 |
|---|---|---|---|---|---|---|---|---|---|---|---|---|
| Organic Solvent | Diols | | 1,2-Propanediol | | | | 21.0 | 21.0 | 21.0 | 21.0 | 21.0 | 21.0 |
| Pore Forming Material Dispersion Liquid | Hollow resin particles (Styrene-acrylic copolymer) | Anionic | SX8782(D) | JSR | | 28 | | | 25.0 | | | |
| | Alumina | Cationic | AS-200 | Nissan Chemical Corporation | 200 | 10.4 | | | | 67.3 | | |
| | Alumina-coated silica | Cationic | ST-AK | Nissan Chemical Corporation | 12 | 19.8 | | | | | 35.4 | |
| | Silica | Cationic | ST-O | Nissan Chemical Corporation | 12 | 20.6 | | | | | | 34.0 |
| | Silica | Anionic | ST-30 | Nissan Chemical Corporation | 12 | 30.4 | | | | | | |
| | Inorganic hollow particle dispersion 1 | Anionic | SILINAX | Nittetsu Mining Co., Ltd. | | 14.1 | | | | | | |

TABLE 1-1-continued

| Category | Treatment Liquid Component | Polarity | Substance/ Product Name | Manu-facturer | Primary Particle Diameter | Conc. (% by mass) | Treatment Liquid No. 1 | 2 | 3 | 4 | 5 | 6 |
|---|---|---|---|---|---|---|---|---|---|---|---|---|
| | Bead-like alumina | Cationic | ALUMINA CLEAR SOL 10A | Kawaken Fine Chemicals Co., Ltd. | | 10 | | | | | | |
| | Bead-like silica | Cationic | ST-OUP | Nissan Chemical Corporation | 12 | 15.3 | | | | | | |
| | Bead-like silica | Anionic | ST-UP | Nissan Chemical Corporation | 12 | 20.3 | | | | | | |
| Resin | Water-soluble resin (polyallyl-amine) | Cationic | PAA-03 | TOYOBO CO., LTD. | | 20 | 25.0 | | | | | |
| | Resin particles (polyolefin-based) | Cationic | ARROWEASE CD-1200 | UNITIKA LTD. | | 20 | | 25.0 | | 0.5 | 0.5 | 0.5 |
| | Polyurethane resin emulsion | Anionic | SUPERFLEX 420NS | DKS Co., Ltd. | 10 | 20 | | | 0.5 | | | |
| Surfactant | Fluorine-based surfactant | Nonionic | FS-34 | DuPont de Nemours, Inc. | | 51 | 1.0 | 1.0 | 1.0 | 1.0 | 1.0 | 1.0 |
| Defoamer | Nonionic surfactant | Nonionic | 2,4,7,9-Tetradecane-4,7-diol | | | 100 | 0.20 | 0.20 | 0.20 | 0.20 | 0.20 | 0.20 |
| | Fungicide | | PROXEL LV | | | 100 | 0.05 | 0.05 | 0.05 | 0.05 | 0.05 | 0.05 |
| | Antioxidant | | 1,2,3-Benzotriazole | | | 100 | 0.05 | 0.05 | 0.05 | 0.05 | 0.05 | 0.05 |
| | | Water | | | | | 51.77 | 50.77 | 49.27 | 5.96 | 36.92 | 37.29 |
| | | Total (parts by mass) | | | | | 100 | 100 | 100 | 100 | 100 | 100 |

TABLE 1-2

| Category | Treatment Liquid Component | Polarity | Substance/ Product Name | Manu-facturer | Primary Particle Diameter | Conc. (% by mass) | 7 | 8 | 9 | 10 | 11 | 12 |
|---|---|---|---|---|---|---|---|---|---|---|---|---|
| Organic Solvent | Diols | | 1,2-Propanediol | | | | 21.0 | 21.0 | 21.0 | 21.0 | 21.0 | 21.0 |
| Pore Forming Material Dispersion Liquid | Hollow resin particles (Styrene-acrylic copolymer) | Anionic | SX8782(D) | JSR | | 28 | | | | | | |
| | Alumina | Cationic | AS-200 | Nissan Chemical Corporation | 200 | 10.4 | | | | | | |
| | Alumina-coated silica | Cationic | ST-AK | Nissan Chemical Corporation | 12 | 19.8 | | | | | | |
| | Silica | Cationic | ST-O | Nissan Chemical Corporation | 12 | 20.6 | | | | | | |
| | Silica | Anionic | ST-30 | Nissan Chemical Corporation | 12 | 30.4 | 23.0 | | | | | 23.0 |
| | Inorganic hollow particle dispersion 1 | Anionic | SILINAX | Nittetsu Mining Co., Ltd. | | 14.1 | | 49.6 | | | | |
| | Bead-like alumina | Cationic | ALUMINA CLEAR SOL 10A | Kawaken Fine Chemicals Co., Ltd. | | 10 | | | 70.0 | | | |
| | Bead-like silica | Cationic | ST-OUP | Nissan Chemical Corporation | 12 | 15.3 | | | | 45.8 | | |
| | Bead-like silica | Anionic | ST-UP | Nissan Chemical Corporation | 12 | 20.3 | | | | | 34.5 | |

TABLE 1-2-continued

| Category | Treatment Liquid Component | Polarity | Substance/ Product Name | Manu-facturer | Primary Particle Diameter | Conc. (% by mass) | 7 | 8 | 9 | 10 | 11 | 12 |
|---|---|---|---|---|---|---|---|---|---|---|---|---|
| Resin | Water-soluble resin (polyallylamine) | Cationic | PAA-03 | TOYOBO CO., LTD. | | 20 | | | | | | |
| | Resin particles (polyolefin-based) | Cationic | ARROWEASE CD-1200 | UNITIKA LTD. | | 20 | | | 0.5 | 0.5 | | |
| | Polyurethane resin emulsion | Anionic | SUPERFLEX 420NS | DKS Co., Ltd. | 10 | 20 | 0.5 | 0.5 | | | 0.5 | 0.5 |
| Surfactant | Fluorine-based surfactant | Nonionic | FS-34 | DuPont de Nemours, Inc. | | 51 | 1.0 | 1.0 | 1.0 | 1.0 | 1.0 | 1.0 |
| Defoamer | Nonionic surfactant | Nonionic | 2,4,7,9-Tetradecane-4,7-diol | | | 100 | 0.20 | 0.20 | 0.20 | 0.20 | 0.20 | 0.20 |
| | Fungicide | | PROXEL LV | | | 100 | 0.05 | 0.05 | 0.05 | 0.05 | 0.05 | 0.05 |
| | Antioxidant | | 1,2,3-Benzotriazole | | | 100 | 0.05 | 0.05 | 0.05 | 0.05 | 0.05 | 0.05 |
| Water | | | | | | | 47.24 | 19.62 | −1.72 | 21.52 | 31.79 | 43.22 |
| Total (parts by mass) | | | | | | | 100 | 100 | 100 | 100 | 100 | 100 |

Preparation of Metallic Ink

Preparation of Silver Particle Dispersion Liquid 1

First, 66.8 g of silver nitrate, 5.2 g of a polymeric dispersant having carboxyl group (DISPERBYK 190 (BYK-190), product of BYK Japan KK, solvents: water and 40% by mass of non-volatile components, acid value: 10 mgKOH/g, amine value 0 mgKOH/g), and 1.8 g of cholic acid (product of Wako Pure Chemical Industries, Ltd.) were poured in 35 g of ion-exchange water and vigorously stirred, thus obtaining a suspension liquid. Next, 9.1 g of an amine solution (i.e., 23.3% aqueous solution of dimethylaminoethanol), prepared by mixing 1.1 g of dimethylaminoethanol (product of Wako Pure Chemical Industries, Ltd.) with 7.0 g of water, were gradually added to the suspension liquid while keeping the liquid temperature not to exceed 50° C., and thereafter heat-stirred in a water bath at a temperature of 60° C. for 2.5 hours. The resulted reaction liquid was filtered with a glass filter (product of ADVANTEC, GC-90 having an average pore diameter of 0.8 μm), thus obtaining a silver particle dispersion liquid 1 containing 40% by mass of silver, 3% of non-volatile components of BYK-190, and 1% of dimethylaminoethanol. A particle size distribution of the silver particles in the silver particle dispersion liquid 1 was measured using a particle size analyzer (NANOTRAC WAVE-EX150, product of Nikkiso Co., Ltd.). As a result, the number average particle diameter (D50) of the primary particles was 20 nm.

Metallic inks 1 to 5 were prepared according to the descriptions presented in Table 2.

TABLE 2

| Category | Ink Components | Polarity | Conc. (% by mass) | Metallic Ink No 1 | 2 | 3 | 4 | 5 |
|---|---|---|---|---|---|---|---|---|
| Pigment | Silver particle dispersion liquid 1 | Anionic | 50 | 10.0 | 10.0 | 10.0 | 10.0 | 10.0 |
| | Flat-plate aluminum pigment dispersion liquid 1 | Anionic | 20 | | | | | |
| Organic Solvent | 1,2-Propanediol | | 100 | 18.0 | 18.0 | 18.0 | 18.0 | 18.0 |
| Surfactant | TEGO TWIN 4000 | Anionic | 100 | 0.5 | | | | |
| | TEGO WET270 | Anionic | 100 | | 0.5 | 0.2 | | |
| | TEGO WET250 | Anionic | 100 | | | | 0.05 | |
| Defoamer | 2,4,7,9-Tetradecane-4,7-diol | Anionic | 100 | 0.2 | 0.2 | 0.2 | 0.2 | 0.2 |
| Penetrant | 3-Ethyl-3-hydroxyoxetane | | 100 | 8.0 | 8.0 | 8.0 | 8.0 | 8.0 |
| Preservative | PROXEL LV | | 100 | 0.1 | 0.1 | 0.1 | 0.1 | 0.1 |
| Polyurethane resin emulsion | SUPERELEX 420NS | Anionic | 20 | 25.0 | 25.0 | 25.0 | 25.0 | 25.0 |
| Antioxidant | 1,2,3-Benzotriazole | | 100 | 0.05 | 0.05 | 0.05 | 0.1 | 0.05 |
| | Water | | | 38.2 | 38.2 | 38.5 | 39 | 38.7 |
| Total (parts by mass) | | | | 100 | 100 | 100 | 100 | 100 |

Examples 1 to 11 and Comparative Examples 1 to 6

Using an ink set including a treatment liquid and a metallic ink as presented in Table 3, printed matter was produced based on the following image recording method 1. The ranks for "20° glossiness", "bleeding", and "unevenness" were evaluated for each printed matter. The results of rank evaluation are presented in Table 3.

TABLE 3-1

| | Comparative Examples | | | | | Examples | | |
|---|---|---|---|---|---|---|---|---|
| | 1 | 2 | 3 | 4 | 5 | 1 | 2 | 3 |
| Recording Liquid | Metallic ink 3 | Metallic ink 3 | Metallic ink 3 | Metallic ink 3 | Metallic ink 1 | Metallic ink 2 | Metallic ink 3 | Metallic ink 4 |
| Treatment Liquid | None | Treatment liquid 1 | Treatment liquid 2 | Treatment liquid 12 | Treatment liquid 7 | Treatment liquid 7 | Treatment liquid 7 | Treatment liquid 7 |
| Recording Liquid Surface Tension (mN/m) | 21 | 21 | 21 | 21 | 18 | 19 | 21 | 28 |
| 28 mN/m ≥ Recording Liquid Surface Tension ≥ 19 mN/m | Yes | Yes | Yes | Yes | No | Yes | Yes | Yes |
| Treatment Liquid Surface Tension (mN/m) | — | 19 | 19 | 28 | 19 | 19 | 19 | 19 |
| Recording Liquid Surface Tension ≥ Treatment Liquid Surface Tension | — | Yes | Yes | No | No | Yes | Yes | Yes |
| 20° Glossiness | C | C | C | B | A | A | A | A |
| Boundary Bleeding | B | B | B | C | C | B | B | B |
| Unevenness | B | C | C | B | A | A | A | B |

TABLE 3-2

| | Comp. Example | Examples | | | | | | | |
|---|---|---|---|---|---|---|---|---|---|
| | 6 | 4 | 5 | 6 | 7 | 8 | 9 | 10 | 11 |
| Recording Liquid | Metallic ink 5 | Metallic ink 3 | Metallic ink 3 | Metallic ink 3 | Metallic ink 3 | Metallic ink 3 | Metallic ink 2 | Metallic ink 2 | Metallic ink 2 |
| Treatment Liquid | Treatment liquid 7 | Treatment liquid 3 | Treatment liquid 4 | Treatment liquid 5 | Treatment liquid 6 | Treatment liquid 8 | Treatment liquid 9 | Treatment liquid 10 | Treatment liquid 11 |
| Recording Liquid Surface Tension (mN/m) | 30 | 21 | 21 | 21 | 21 | 21 | 21 | 21 | 21 |
| 28 mN/m ≥ Recording Liquid Surface Tension ≥ 19 mN/m | No | Yes | Yes | Yes | Yes | Yes | Yes | Yes | Yes |
| Treatment Liquid Surface Tension (mN/m) | 19 | 19 | 19 | 19 | 19 | 19 | 19 | 19 | 19 |
| Recording Liquid Surface Tension ≥ Treatment Liquid Surface Tension | Yes | Yes | Yes | Yes | Yes | Yes | Yes | Yes | Yes |
| 20° Glossiness | A | B | B | B | A | B | AA | S | AAA |
| Boundary Bleeding | B | B | A | A | A | B | A | A | A |
| Unevenness | C | A | A | A | A | A | A | A | A |

Image Recording Method 1: Pre-Jetting Image Recording Method

In Examples 1 to 11 and Comparative Examples 1 to 6, printed matter was prepared using a modified machine of a line-type inkjet recording apparatus RICOH PRO VC60000. The printed matter was produced by discharging a treatment liquid and a metallic ink from an upstream head and a downstream head, respectively, with respect to a sheet feeding direction. Since both heads were sufficiently separated from each other, nozzle clogging did not occur during printing. The modified machine is equipped with a drying mechanism for drying the treatment liquid on the recording medium. The drying mechanism is disposed between the upstream head group for discharging the treatment liquid and the downstream head group for discharging the metallic ink.

Printing was performed using OK TOP COAT+ (127.9 g/m$^2$) (product of Oji Paper Co., Ltd.) as a recording medium, at a resolution of 600 dpi×600 dpi and a sheet feeding rate of 5 m/min.

It was confirmed that there were pores in the porous layer by observing an image of the porous layer on the recording medium using a scanning electron microscope (SEM).

Rank Evaluation for 200 Glossiness

The 20° glossiness of each recorded matter having been dried was measured using a gloss meter (micro-TRI-gloss, product of BYK-Gardener).

Assuming printing on coated paper, the 20° glossiness is preferably 40 or more, and more preferably 100 or more. In the present disclosure, the acceptable range of the 20° glossiness is 40 or more. (Rank B and above are acceptable).

Evaluation Criteria

S: The 20° glossiness is 225 or more.

AAA: The 20° glossiness is 200 or more and less than 225.

AA: The 20° glossiness is 160 or more and less than 200.

A. The 20° glossiness is 100 or more and less than 160.

B: The 20° glossiness is 40 or more and less than 100.

C: The 20° glossiness is less than 40.

Rank Evaluation for Bleeding

Figure 8:
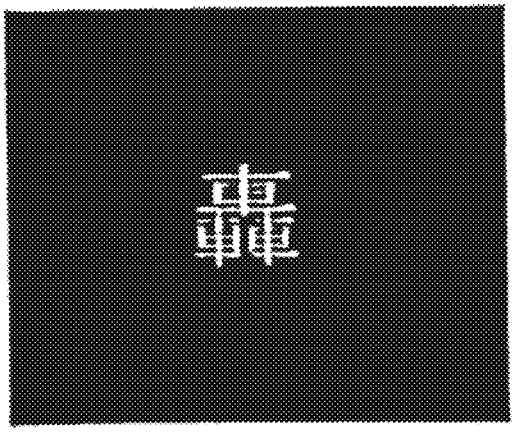
FIG. 8 is a printed image used for the rank evaluation for bleeding in Examples of the present disclosure.

Printed matter was produced by printing a character "鬱" outlined in white at 6 points on a solid image formed of a metallic ink, as shown in FIG. 8. The character "鬱" was observed to evaluate the degree of bleeding.

In the pre-coating method, the treatment liquid is printed inside the character "鬱".

In the pre-jetting method, the treatment liquid is not printed inside the character "".

Rank B and above are acceptable.

Evaluation Criteria

A: Feathering does not occur. Character collapse does not occur.

B: Feathering is slightly occurring, and bleeding is observed. Character is readable.

C: Feathering is clearly occurring. Character is unclear.

Rank Evaluation for Unevenness

Solid image of each treatment liquid and each metallic ink, with a size of 15 cm×15 cm, was printed at 600 dpi×600 dpi and 100% duty. The solid images were observed and evaluated based on the following evaluation criteria.

Evaluation Criteria

A: Unevenness is not observed. The solid image is uniform.

B: Slight unevenness is observed. When viewed at a distance of 5 m or more, solid unevenness cannot be recognized.

C: Clear unevenness is observed. The solid image is non-uniform.

Rank B and above are acceptable.

Comparative Example 7 and Examples 12 to 14

In Comparative Example 7 and Examples 12, 13, and 14, printed matter was produced using the same ink set in Comparative Example 4 and Examples 2, 10, and 11 based on the following image recording method 2.

The ranks for "20° glossiness", "bleeding", and "unevenness" were evaluated for each printed matter in the same manner as in Comparative Example 4 and Examples 2, 10, and 11. The results of rank evaluation are presented in Table 4.

As a recording medium, OK TOP COAT+(127.9 g/m$^2$) was used.

TABLE 4

| | Comp. Example 7 | Example 12 | Example 13 | Example 14 |
|---|---|---|---|---|
| Recording Liquid | Metallic ink 3 | Metallic ink 3 | Metallic ink 2 | Metallic ink 2 |
| Treatment Liquid | Treatment liquid 12 | Treatment liquid 7 | Treatment liquid 10 | Treatment liquid 11 |
| Recording Liquid Surface Tension (mN/m) | 21 | 21 | 21 | 21 |
| 28 mN/m ≥ Recording Liquid Surface Tension ≥ 19 mN/m | Yes | Yes | Yes | Yes |
| Treatment Liquid Surface Tension (mN/m) | 28 | 19 | 19 | 19 |
| Recording Liquid Surface Tension ≥ Treatment Liquid Surface Tension | No | Yes | Yes | Yes |
| 20° Glossiness | B | A | S | AAA |
| Boundary Bleeding | C | B | A | A |
| Unevenness | B | A | A | A |

Image Recording Method 2. Pre-Coating Image Recording Method

In the pre-coating image recording method, the treatment liquid is first made to coat a part or the entire of a recording medium using a roller, bar coater, spray, or the like, and then the metallic ink is applied by an inkjet method to the recording medium that has been coated with the treatment liquid.

In Comparative Example 7 and Examples 12 to 14, printed matter was prepared using a modified machine of a serial-type inkjet recording apparatus (IPSIO GXe 5500, product of Ricoh Co., Ltd.). After replacing the duplex-printing sheet feeding unit 181 with the pre-coating device illustrated in FIG. 5A, the recording medium was coated with the treatment liquid by the coating roller 5, then the metallic ink was discharged from a downstream head to prepare printed matter. The modified machine is equipped with a drying mechanism for drying the treatment liquid on the recording medium. The drying mechanism is disposed on a lower surface of a conveyance path for conveying the recording medium having coated with the treatment liquid at an upstream position.

Printing with the metallic ink was performed using OK TOP COAT+(127.9 g/m$^2$) (product of Oji Paper Co., Ltd.) as a recording medium, at a resolution of 600 dpi×600 dpi and the high-grade plain paper standard mode.

It was confirmed that there were pores in the porous layer by observing an image of the porous layer on the recording medium using a scanning electron microscope (SEM).

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image recording method comprising:

applying a treatment liquid containing a pore forming material onto a recording medium to form a porous layer; and applying a metallic ink containing a metallic pigment onto the porous layer, wherein a surface tension of the metallic ink at 23° C. is equal to or greater than a surface tension of the treatment liquid at 23° C., wherein the surface tension of the metallic ink at 23° C. is 19 mN/m or more and 28 mN/m or less, and wherein the metallic pigment comprises at least one pearl pigment selected from the group consisting of: titanium-dioxide-coated mica, fish scale foil, and bismuth oxychloride.

2. The image recording method of claim 1, wherein the surface tension of the metallic ink at 23° C. is 21 mN/m or more and 25 mN/m or less, and the surface tension of the treatment liquid at 23° C. is 18 mN/m or more and 23 mN/m or less.

3. The image recording method of claim 1, wherein the pore forming material comprises inorganic particles.

4. The image recording method of claim 3, wherein the inorganic particles comprise at least one of silica and alumina.

5. The image recording method of claim 3, wherein the inorganic particles comprise secondary particles which are aggregates of two or more primary particles, and the inorganic particles are in a head-like shape.

6. The image recording method of claim 1, wherein a proportion of the pore forming material in the treatment liquid is 0.5% by mass or more and 20% by mass or less.

7. The image recording method of claim 1, wherein both of the pore forming material in the treatment liquid and solid contents in the metallic ink are anionic or cationic.

8. The image recording method of claim 1, wherein the treatment liquid and the metallic ink are reactive with each other.

9. The image recording method of claim 1, wherein the treatment liquid and the metallic ink are discharged to the recording medium from an inkjet head by a pre-jetting method.

10. The image recording method of claim 1, wherein the treatment liquid is applied to the recording medium by a pre-coating method.

11. The image recording method of claim 1, further comprising:

drying the metallic ink applied onto the porous layer, thereby obtaining an ink layer without causing unevenness.

12. The image recording method of claim 1, wherein the metallic pigment is a glitter pigment.

13. The image recording method of claim 1, wherein the metallic pigment comprises at least one metal particle selected from the group consisting of: aluminum, silver, gold, platinum, nickel, chromium, tin, zinc, indium, titanium, copper, and any alloy thereof.

14. The image recording method of claim 1, wherein the metallic pigment comprises silver.

15. An ink set comprising:

a treatment liquid; and a metallic ink, wherein a surface tension of the metallic ink at 23° C. is equal to or greater than a surface tension of the treatment liquid at 23° C., wherein the surface tension of the metallic ink at 23° C. is 19 mN/m or more and 28 mN/m or less, and wherein the metallic pigment comprises at least one pearl pigment selected from the group consisting of: titanium-dioxide-coated mica, fish scale foil, and bismuth oxychloride.

* * * * *